United States Patent [19]

Larger

[11] 4,067,766

[45] Jan. 10, 1978

[54] AUTOMATIC BUILDING BLOCK LAYING PANEL-FORMING MACHINE AND METHOD

[76] Inventor: George K. Larger, 3162 La Rosa, Grove City, Ohio 43123

[21] Appl. No.: 660,221

[22] Filed: Feb. 23, 1976

[51] Int. Cl.[2] ..... B32B 31/00; E04D 15/00

[52] U.S. Cl. ..... 156/297; 52/747; 52/749

[58] Field of Search ..... 52/747, 749; 156/297, 156/558

[56] References Cited

U.S. PATENT DOCUMENTS

| | | | |
|---|---|---|---|
| 2,850,890 | 9/1958 | Rubenstein | 52/309 X |
| 3,350,833 | 11/1967 | Larger | 52/744 X |
| 3,834,973 | 9/1974 | Kummerow | 52/747 X |
| 3,849,228 | 11/1974 | Lingl | 52/749 X |
| 3,933,570 | 1/1976 | Wright et al. | 52/749 X |

*Primary Examiner*—Alfred C. Perham
*Attorney, Agent, or Firm*—Wm. V. Miller

[57] ABSTRACT

A machine for automatically laying building blocks and the like into a panel. It includes a supply conveyor for feeding a predetermined number of blocks into the machine in proper sequence to form a course, the blocks standing on end. An in-feed support conveyor receives the blocks while still in upright position. A feeder carriage reciprocates over the in-feed conveyor and carries flow-guns for applying adhesive to the exposed upper ends of the blocks and to the exposed edges of the blocks at different times. The carriage is provided with clamps which, as the carriage advances, successively clamp the blocks for pivotal movement about transverse axes. Beyond the in-feed conveyor, is a course-forming and supporting conveyor which is transversely arranged relative to the in-feed conveyor and, over which the carriage advances, which has pairs of parallel guides for receiving the clamped blocks on the feeder carriage. As the blocks are moved by the advancing carriage into a pair of the aligned guides, they are tilted into horizontal positions, by movement about the transverse clamp axes, and arranged in the guides as a horizontal row of spaced blocks, and are later released by the clamps. The released blocks are slidably pushed together in the guides and centered relative to the conveyor by ram units so that they will adhere as a horizontal course. The course-forming and supporting guide conveyor is advanced inwardly or rearwardly intermittently to advance the formed course successively into engagement with a transfer unit which reciprocates rearwardly and forwardly above the conveyor to successively grip the adhered courses, and at the same time to align other pairs of guides successively with the rows of blocks supplied by the feeder carriage. The transfer unit moves the formed courses successively over a panel-support elevator where they are released, the elevator being lowered gradually so that the courses are laid thereon, with the courses then adhering to form a panel. Automatic programming and timing controls are provided for bringing about all of the operations in proper sequence.

96 Claims, 50 Drawing Figures

FIG. 15a
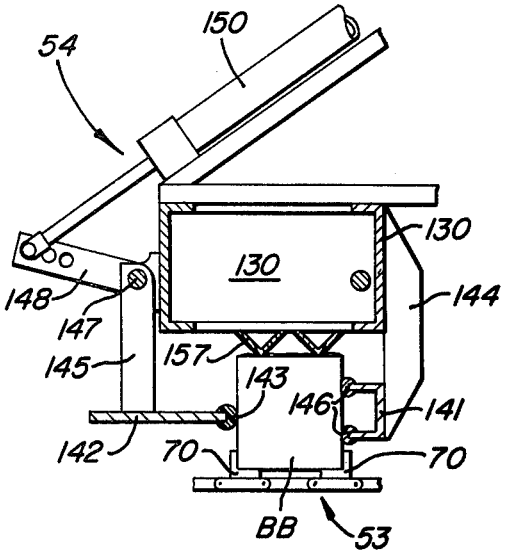
FIG. 14a
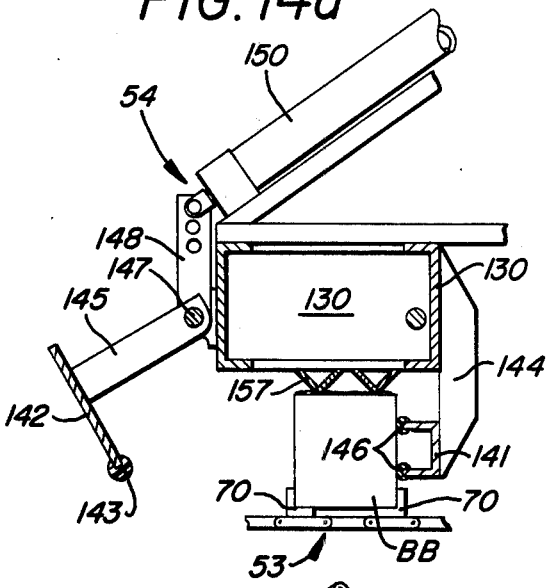
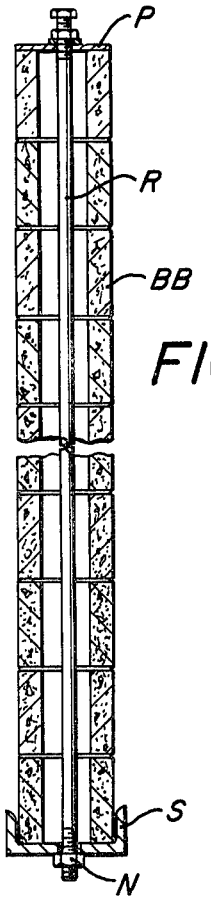
FIG. 18a
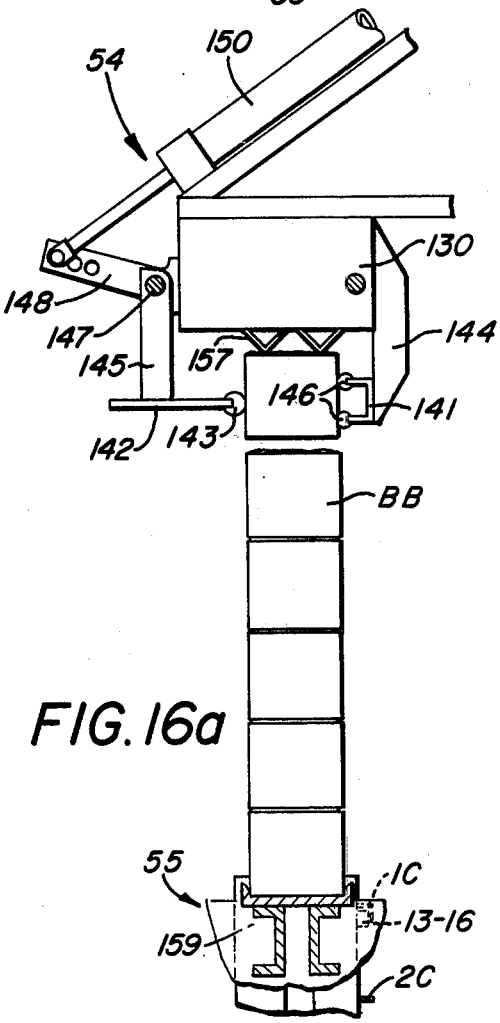
FIG. 16a 50
50a
50b
50c
50d
76
77
78
a'
b'
a
b
86
83
51
51a
51b
51c
51d
51e
61
7a
100
97
105
6a
5a
4a
3a
2a
1a
52
A
B
C
33
87
62
66
128
53b
95
164
55
12
144
150
136
71
130
149
54
135
127
132
133
131
24
53
53a
25
21

| STEP | CLOSED: X | CONTACTS ON PT250 | | | | | | | | | | | | | | | | | | |
|---|---|---|---|---|---|---|---|---|---|---|---|---|---|---|---|---|---|---|---|---|
| | X | 1 | 2 | 3 | 4 | 5 | 6 | 7 | 8 | 9 | 10 | 11 | 12 | 13 | 14 | 15 | 16 | 17 | 18 | 19 |
| 1 | | | | | | | | | | | | X | | | | X | | X | X | |
| 2 | | X | | | | | | | | | | X | | | | | | X | X | |
| 3 | | X | X | | | | | | | | | X | | | | | | | X | |
| 4 | | X | X | X | | | | | | | | X | | | | | | | X | |
| 5 | | X | X | X | X | | | | | | | X | | | | | | | X | |
| 6 | | X | X | X | X | X | | | | | | X | | | | | | | X | |
| 7 | | X | X | X | X | X | X | | | | | X | | | | | | | X | |
| 8 | | X | X | X | X | X | X | X | | | | X | | | | | | | X | |
| 9 | | | | | | | | | X | | | | | | | | | | X | |
| 10 | | | | | | | | | X | X | | | | X | | | | | X | |
| 11 | X | | | | | | | | | | X | | X | X | | | | | | |
| 12 | X | | | | | | | | | | X | | X | X | X | | | | | |
| 13 | X | | | | | | | | | | X | | | X | X | | X | | | |
| 14 | X | | | | | | | | | | X | | | | | | | X | | |
| 15 | X | | | | | | | | | | X | | | | | | | X | | X |
| 16 | | | | | | | | | | | | | | | | X | | X | | X |

FIG. 41

AUTOMATIC BUILDING BLOCK LAYING PANEL-FORMING MACHINE AND METHOD

BACKGROUND OF THE INVENTION

U.S. Pat. No. 3,350,833, issued Nov. 7, 1967, discloses a machine which is not completely automatic and which is particularly suitable for laying bricks to produce a panel, the bricks being bonded by mortar. With that machine the bricks must be loaded into the machine and arranged in a course manually. The present invention relates to a completely automatic machine which is particularly suitable for laying blocks of various standard sizes, although it is not limited thereto, into panels, the blocks being preferably bonded by a standard type adhesive. The machine will feed supplies of blocks into the machine and arrange them in courses and then lay the courses into a panel, all automatically. The machine will lay the blocks in the panel with the courses arranged relatively in conventional-bonding, that is, with the vertical joints staggered, or in stack-bonding, that is, with the vertical joints aligned. It can be readily adjusted to handle blocks of various sizes.

SUMMARY OF THE INVENTION

According to this invention there is provided an automatic-block-laying panel machine which consists mainly of the following units acting generally as indicated:

A supply conveyor for feeding the blocks on end into the machine in proper number and sequence to form the desired course;

An in-feed support conveyor for receiving the blocks from the supply conveyor and supporting them in an upright row;

A feeder carriage which is mounted for reciprocating movement over the in-feed support conveyor and which carries depending clamps that successively clamp the upright blocks, for rotative or tilting movement about transverse axes, as the feeder advances; this feeder carriage is equipped with flow guns which apply adhesive onto the upper exposed ends of the row of supported blocks and the exposed top edges of the blocks of a formed course at different times;

A course-forming and supporting conveyor extending transversely relative to the in-feed conveyor and having pairs of parallel guides successively aligned with the carriage, which also advances over it, for receiving the blocks and arranging them in a horizontal row, as the clamped blocks are turned successively about the respective transverse axes into horizontal positions to form a row of spaced blocks in the aligned pair of support guides;

Rams for engaging the row of blocks on the successive pairs of guides to push the blocks thereof into contact and form the horizontal course of blocks, bonded together at adjacent ends and centered on the conveyor, the blocks being released from the feeder clamps before these actions take place;

A transfer unit that reciprocates back and forth over the course-forming and supporting conveyor and which acts to grip or clamp the successive courses moved into association therewith by rearward movement of the guide conveyor;

A vertically movable elevator located at the rear of the course-forming and supporting guide conveyor for supporting the first and subsequent courses, which are formed on the guides of the conveyor, and successively removed therefrom by the transfer unit and deposited on the elevator, the elevator gradually lowering to accommodate the successively laid courses which will adhere to produce the panel; and an Automatic programming and control system for operating all of the units in proper timed sequence.

Although in the preceding and following description, it is stated that this machine is particularly designed to lay blocks which are bonded together by flowed adhesive, it is to be understood that it could also lay blocks which are bonded by other substances or are not bonded. For example, it could form courses from blocks which have tongue and groove vertical and horizontal joints by pushing the blocks together in a course on the receiving guides and laying them on the elevator into a panel just as described. Also, it could form a panel from plain non-interfitting blocks, without bonding, by pushing them together to form courses which are successively laid into a panel. With both types of blocks, it would be possible to adapt the machine, merely by de-activating the binder flow guns. In each case, after the panel is formed from the un-bonded blocks, one or both of the faces of the panel can be covered with a coating of binder or plaster, as is now done in some block-laying methods.

BRIEF DESCRIPTION OF THE DRAWINGS

The best mode contemplated in carrying out this invention is illustrated in the accompanying drawings in which:

FIG. 14*a* is a vertical sectional view taken along line 14*a*—14*a* of FIG. 14 through the opened transfer unit.

FIG. 15*a* is a vertical sectional view taken along line 15*a*—15*a* of FIG. 15 through the closed transfer unit.

FIG. 16*a* is an end view taken from the position indicated by the line 16*a*—16*a* of FIG. 16.

FIG. 18*a* is a vertical sectional view of the completed panel produced by the machine.

FIG. 41 is a graphical representation of the programmed operating times of the timer.

DETAILED DESCRIPTION OF THE INVENTION

With more detailed reference to the drawings, the basic steps of the method and the basic operations of the machine, are indicated successively in FIGS. 1 to 18, inclusive. The general layout of the machine is indicated schematically in FIGS. 19, 20 and 20*a*, and details of the machine are indicated in the remaining Figures. It is shown fixed but could be mobile.

Figure 19:
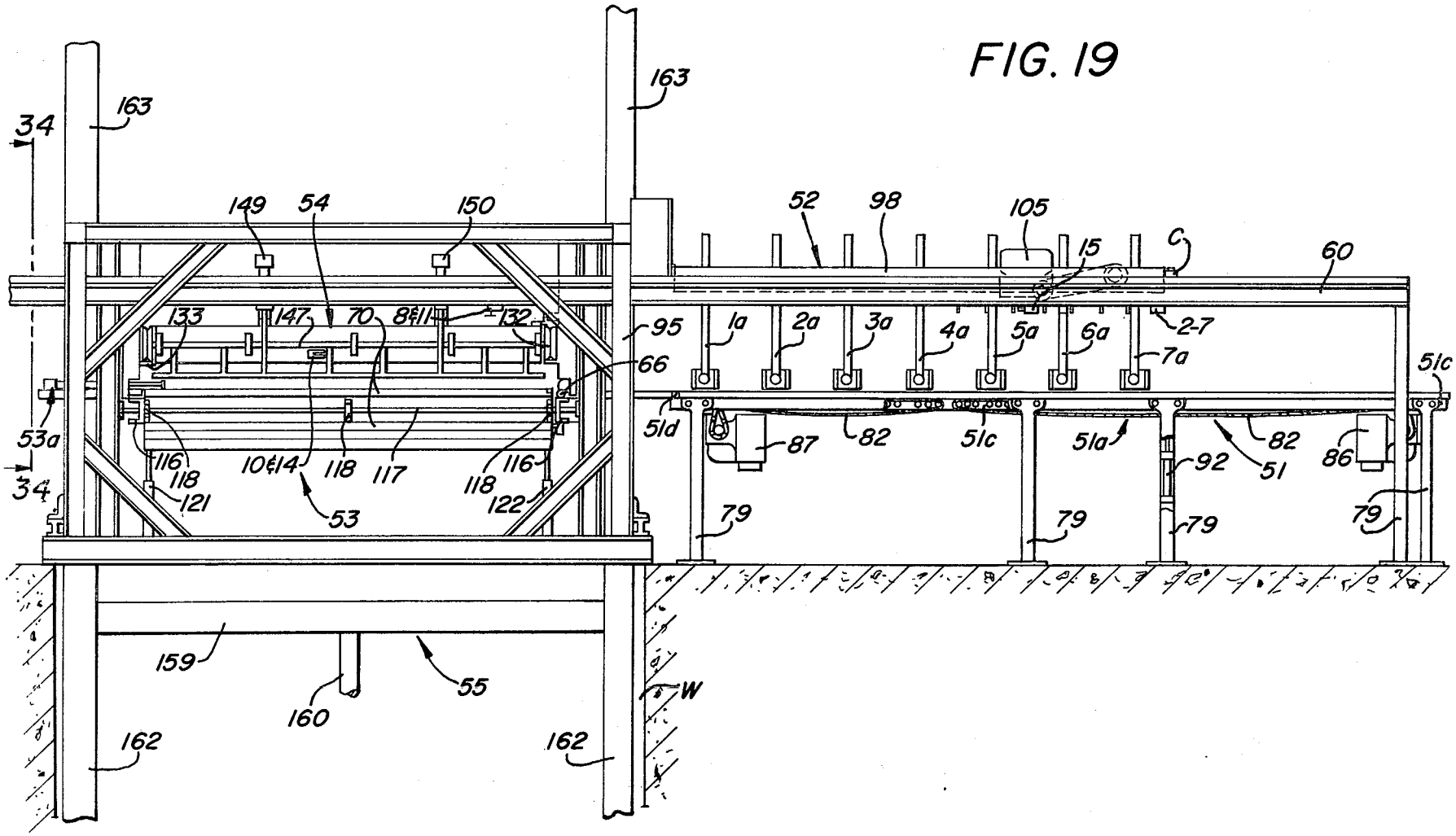
FIG. 19 is a front elevational view of the block-laying machine of this invention.
Figures 20, 20A:
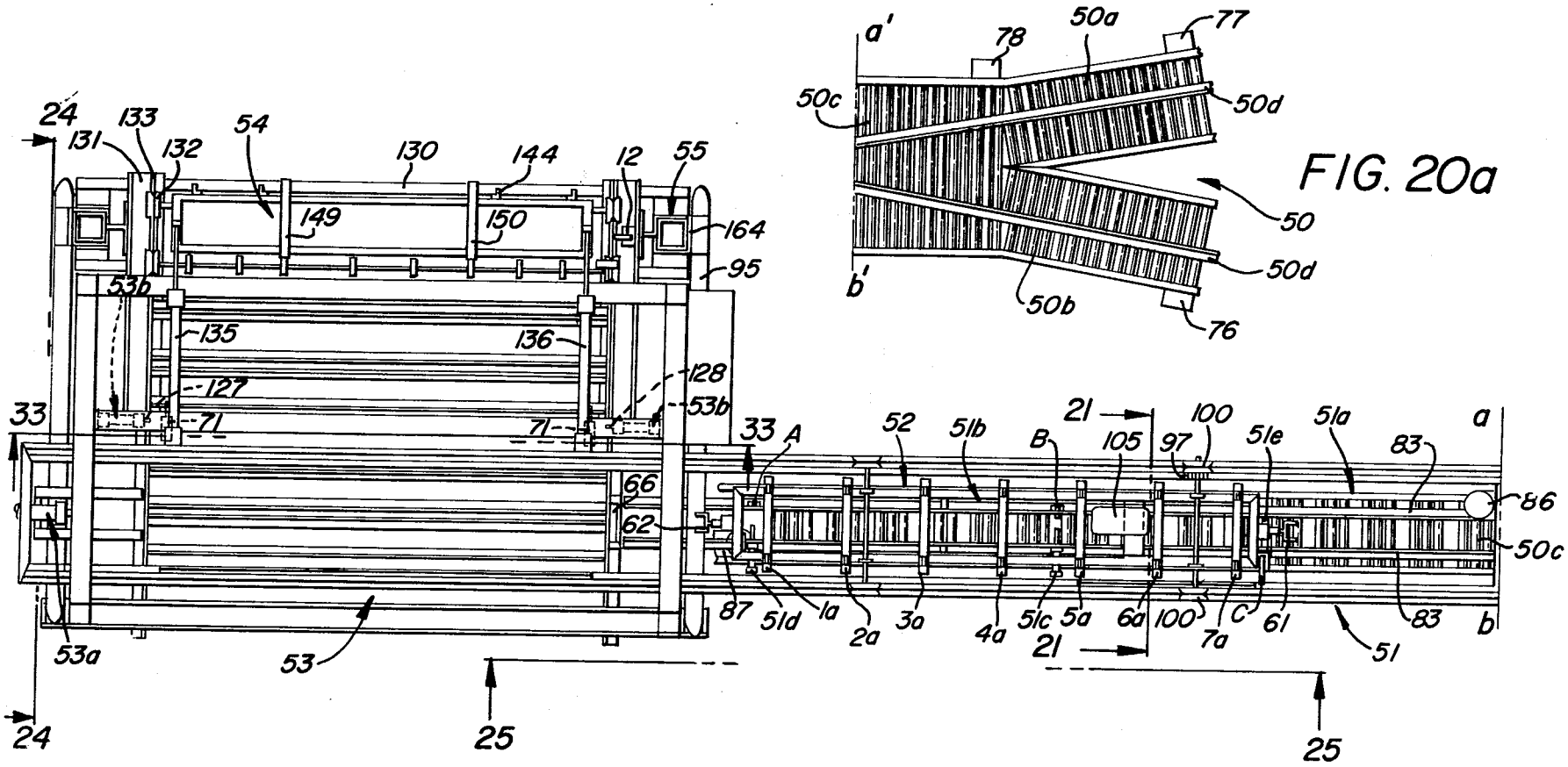
FIG. 20 is a top plan view of the machine.
FIG. 20*a* is a top view of the supply conveyor of the machine, the outlet end indicated by line *a'-b'* being connected to the inlet end of the machine at the line *a-b* of FIG. 20.

As previously indicated and as shown in FIGS. 19, 20 and 20*a*, the machine consists basically of the following units: a supply conveyor 50 for feeding the blocks BB into the machine on end and in proper number and sequence to form the desired courses; an in-feed support conveyor 51 for receiving the upright blocks from the supply conveyor and supporting and forming them into successive rows; a block clamp and flow-gun-carrying reciprocal feeder carriage 52; a course-forming and guide-supporting conveyor 53, having rams 53*a* and 53*b* cooperating therewith for pushing the row of blocks so that their ends are in contact and for centering the resulting bonded course of blocks on the guide conveyor; a transfer unit 54 that reciprocates rearwardly and inwardly over the course-forming and guide-carrying conveyor 53; and a vertically-movable elevator 55 at the rear of the guide-carrying conveyor 53 for receiving the courses of blocks successively transferred from the conveyor 53 by the transfer unit 54.

The supply conveyor 50 (FIG. 20*a*) includes three sections 50*a* and 50*b* and 50*c* arranged in Y-form for feeding successive supplies of blocks in proper number to the in-feed conveyor 51. For example, if the blocks are to be laid in the panel in the conventional bonding arrangement, the one section 50*a* or 50*b* of the conveyor will feed all full blocks, loaded thereon, onto the common section 50*c* and the other section 50*a* or 50*b* will feed both full and half blocks loaded thereon. In the example indicated in the drawings, six full blocks are fed by the one section of the conveyor and five full blocks, with half-blocks at opposed ends, are fed by the other section onto the common section 50*c* thereof which leads onto the in-feed conveyor 51. This is accomplished by alternate operation of the two intermittently driven sections 50*a* and 50*b*. Thus, in FIG. 1 there is shown two rows of blocks BB resting on the conveyor 51 on end, the leading row being all full blocks and the following row including first and last half-blocks. The in-feed conveyor is provided with two independently driven sections 51*a* and 51*b*. As indicated, the ram-actuated stop 51*c* cooperated with the conveyor section 51*a* to stop the row of blocks thereon and the stop 51*d* cooperates with the conveyor section 51*b* to stop the row of blocks thereon, these stops being properly timed. It will be noted that stop 51*c* is located slightly behind the leading end of conveyor section 51*a* and stop 51*d* is located similarly relative to section 51*b*. Cooperating with the section 51*a* is ram-operated lift 51*e* for lifting the last half-block in a row of blocks supported on conveyor section 51*a* which is indicated as the following row in FIG. 1. Lift 51*e* is located substantially behind the stop 51*c*, specifically, located seven blocks from the stop.

Figure 1:
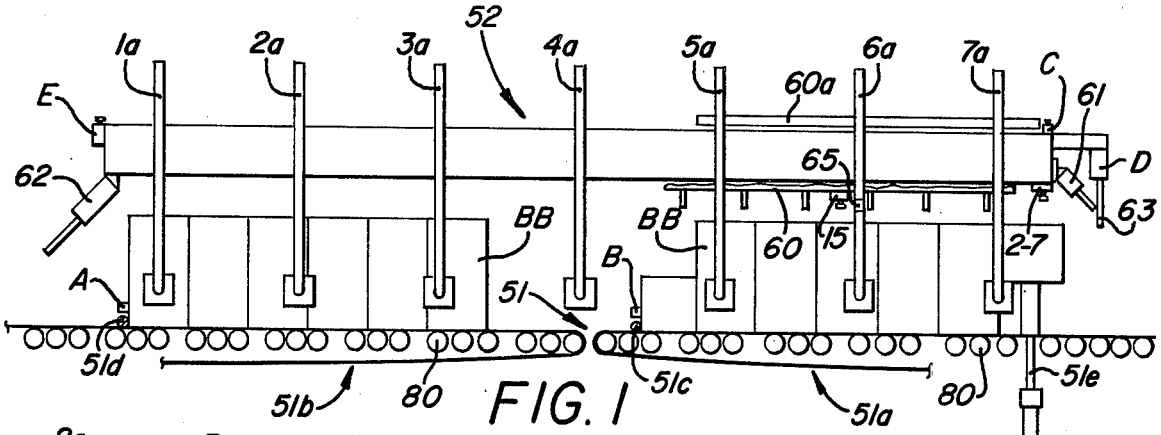
FIG. 1 is a schematic view illustrating a starting position of the feeder carriage associated with two successive rows of upright blocks ready to be advanced into the machine, the leading row being all full blocks and the succeeding row including half-blocks at its ends.

The carriage 52 reciprocates over the conveyor 51 and it can be assumed that it is in its initial position in FIG. 1 where it is disposed over the sections 51*a* and 51*b*. The lift 51*e* is located toward the inlet end of the section 51*a* and is raised as indicated to raise the last half-block of the row. The carriage 52 is reciprocably mounted for horizontal movement over the conveyor 51 and conveyor 53. It is provided with seven block clamps consisting of pairs of cooperating clamping members. The clamps are designated, respectively, by the reference characters 1*a* to 7*a*, beginning with the leading clamp to the left. The carriage 52 reciprocates relative to switch-actuating clips for switching means which actuate the clamps 2*a* to 6*a*, respectively, and are carried by a stationary support 60 at longitudinally spaced intervals over the conveyor section 51*a*, the clips being numbered 2*b* to 7*b* inclusive, in reverse sequence as compared to the clamps 1*a* to 7*a*, that is beginning at the right. No actuating clip is provided for clamp 1*a* as this clamp is actuated by the timer of the electric circuit.

The carriage 52 carries at its opposite ends flow guns 61 and 62 which have nozzles of U-form (FIG. 20) depending therefrom to flow onto the edges of the block, adjacent the front and rear faces thereof, a suitable adhesive or bonding substance. A standard flowable plastic type now used in block-laying is suitable but standard types of abrasive, fiber-reinforced, etc., may be used. In addition, the carriage 52 carries at its right-hand or trailing end, an electric one-way limit switch D which has a depending flexible actuating trigger 63 that is adapted to engage the exposed top ends of the row of blocks on conveyor section 51*a* to control the leading flow gun 61. At the same end the limit switch 2–7 is carried by the carriage 52 at its lower trailing corner, this switch controlling actuation of clamps 2*a* to 7*a*. At its upper trailing corner, the carriage 52 carries a limit switch C, which cooperates with switch D for controlling the trailing flow gun 61 by contacting with a longitudinally extending stationary member 60*a* (FIG. 10), relative to which the carriage reciprocates. A similar switch E which operates only in one direction and located at the forward and upper corner of the carriage 52 engages a stationary member 60*c* (FIG. 12) for controlling flow gun 62. The support 60 also carries a limit switch 15, over the conveyor section 51*a*, which stops movement of the carriage by engagement with a lug 65 on the clamp 6*a*. Switch 8 and 11 operates in both directions as do switches 10 and 14 and 13 and 16.

Figure 4:
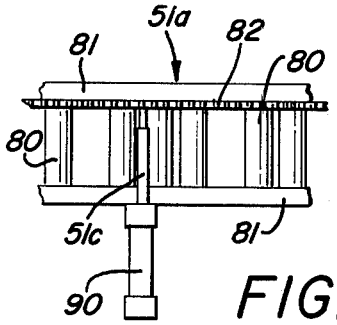
FIG. 4 is a horizontal sectional view taken along line 4—4 of FIG. 3 showing a block-stopping ram.
Figure 5:
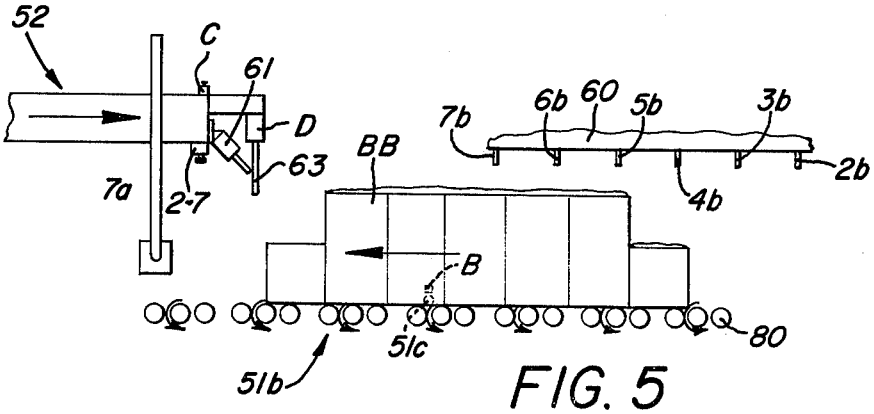
FIG. 5 is a schematic view showing the reverse movement of the carriage to the right and the advancement of the second row of blocks farther into the machine to the left.

With reference to FIG. 1, as a starting position, assume that the leading row of six full blocks has been moved onto the section 51*b* of the conveyor 51 and has been stopped by the stop 51*d*, with the first block already gripped by clamp 1*a*, and that the trailing row of blocks, including the five full blocks and two half blocks, has been moved onto the section 51*a* of the conveyor and has been stopped by the stop 51*c*. Also assume the last half block has been lifted, as indicated, by the lift 51*e* and that the carriage 52 is in the position indicated with the trigger 63 out of contact with the lifted half-block. This initial positioning of the two succeeding rows of blocks is accomplished by proper operation of the conveyors 50 and 51, by the programmed timer PT250 of the electrical circuit shown in FIG. 39, to advance the leading block of the row of blocks into engagement with a stationary limit switch A, at the leading end of conveyor section 51*b*, and the leading block of the succeeding row into contact with a similar switch B, at the leading end of the conveyor section 51*a*. As shown in FIG. 20, the switches A and B are fixed at proper locations along the conveyor 51. The stops 51*d* and 51*c* are of the ram-actuated type and each projects across the conveyor at the proper longitudinal position as indicated in FIG. 4.

Figure 2:
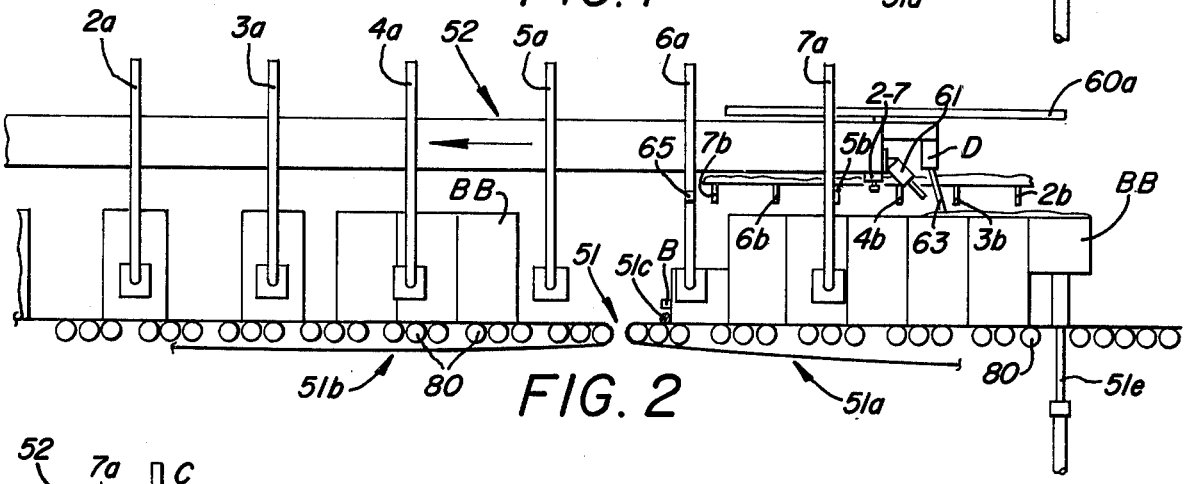
FIG. 2 is a similar view illustrating the reciprocal feeder and flow gun carriage advancing inwardly into the machine or to the left to successively clamp the leading row of upright blocks and coat the upper ends of the following row of blocks with adhesive.
Figure 3:
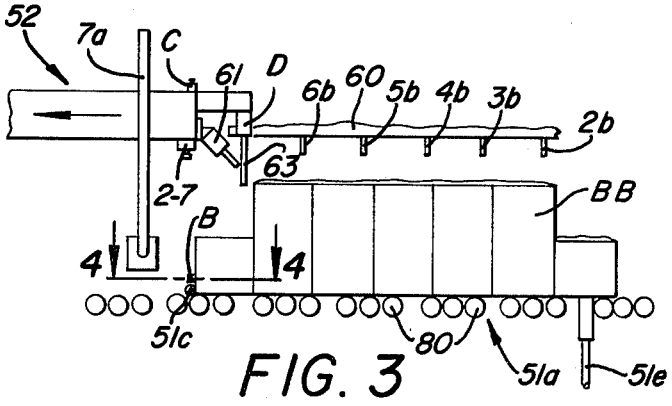
FIG. 3 illustrates the coating of the top ends of the blocks finished as the carriage advances on to the left with the following or second row of upright blocks stopped.

The movement of the trailing row of blocks, those blocks positioned on conveyor section 51*b* through the machine will now be described. As the carriage 52 starts, the switch trigger 63 engages the lifted half block and switch C engages the member 60*a* to actuate the flow gun 61 and coat the upper exposed ends of the blocks positioned on conveyor 51*a* with the adhesive, while the flow gun 61 moves with the carriage 52 as indicated in FIG. 2. The switch C will disengage from the member 60*a* so that the leading block will not be coated on its end. The upper ends of the blocks on conveyor 51*b* were previously coated in a similar manner when positioned on conveyor 51*a*. FIGS. 1, 2, 3 and 5 diagramatically illustrate movement of the row of blocks off conveyor 51*b* and the coating of the upper ends of the blocks supported on conveyor 51*a*. Movement of a course of blocks including half-blocks is illustrated in the other Figures. This also illustrates the lifting of the trailing half-block that is required to obtain a coating of adhesive on its one end. It will be noted that the half-block lift 51*e* is operated when six full blocks are positioned on conveyor 51*a* but is ineffective since none of the blocks will be positioned over the lift.

Figure 6:
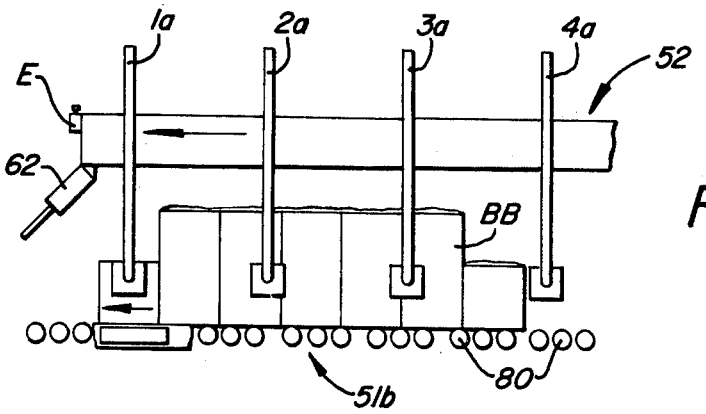
FIG. 6 shows the second row of blocks, with the first half-block thereof clamped or gripped by the pivotal clamps on the advancing carriage, the carriage starting to move to the left.
Figure 7:
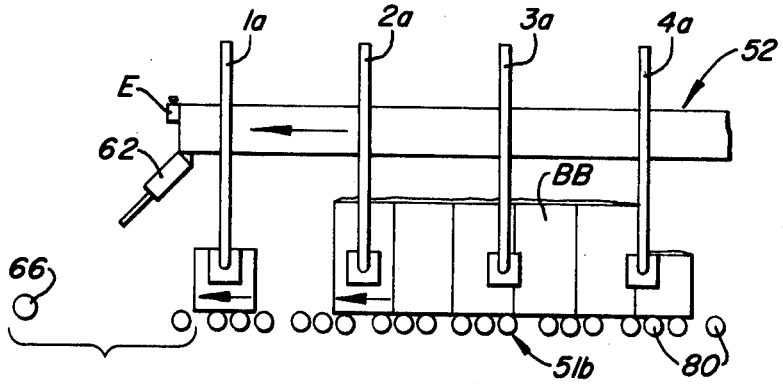
FIG. 7 is a view similar to FIG. 6 showing the carriage continuing to advance to the left, the row of blocks also moving to the left, and the second clamp of the carriage clamping the second block.
Figure 8:
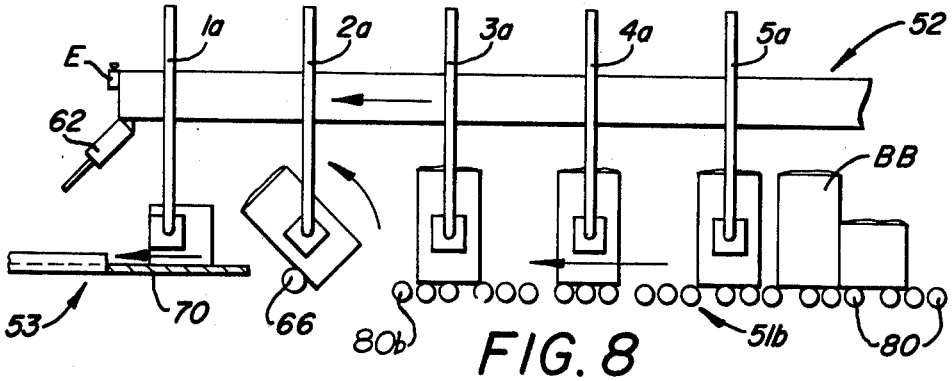
FIG. 8 shows the successive blocks being clamped by the clamps of the advancing carriage, the second block or first full block being rotated 90° by engagement with the tilting-roller which has previously caused rotation of the first or half-block.
Figure 9:
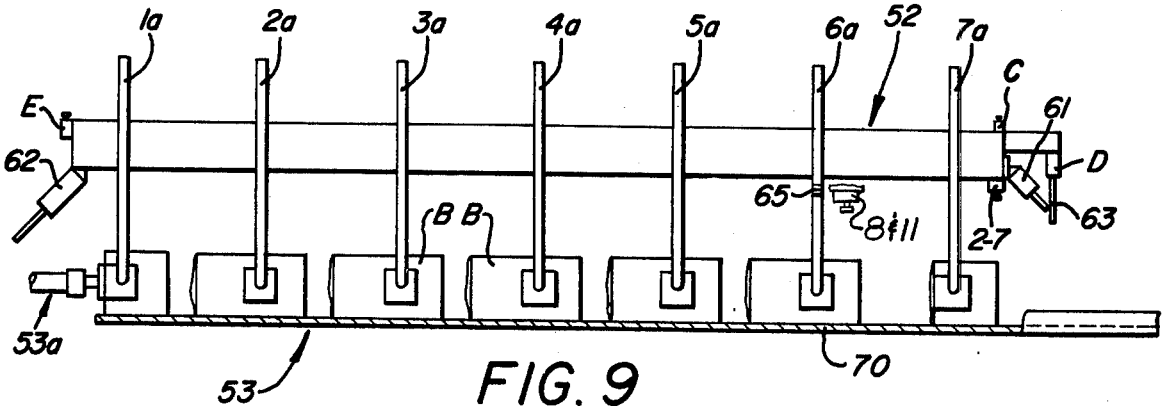
FIG. 9 shows all of the blocks in horizontal spaced position on the course-forming conveyor with the carriage advanced to cause the leading half-block to be engaged by a pushing ram.
Figure 10:
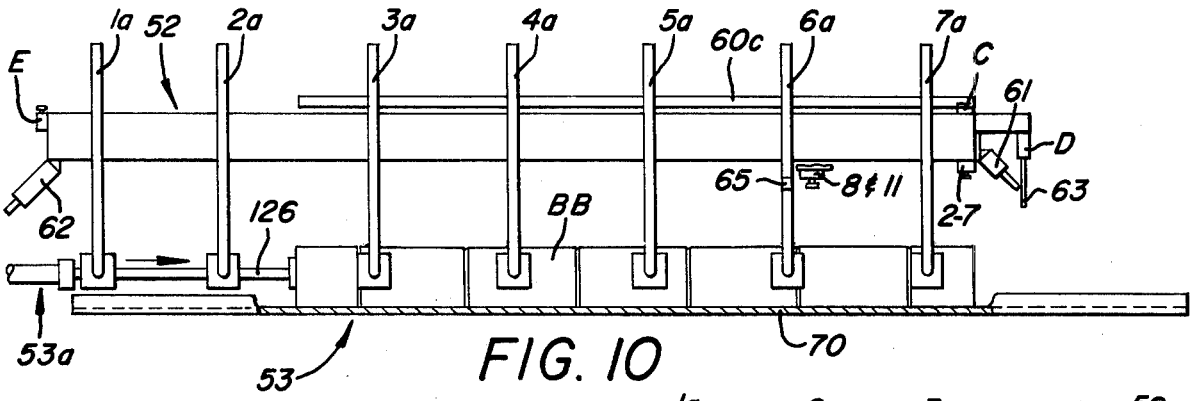
FIG. 10 shows the pushing ram pushing all of the blocks of the row together, after release by the clamps, with their adjacent ends in bonding contact to form the complete course.
Figure 13A:
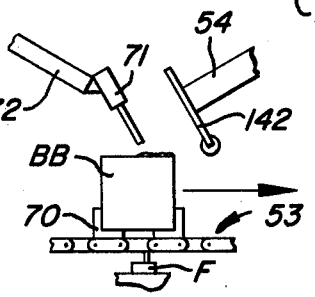
FIG. 13*a* is an end view of FIG. 13 showing one of the two flow guns that coat the top transverse edges of the course of blocks at its opposed ends.
Figure 13:
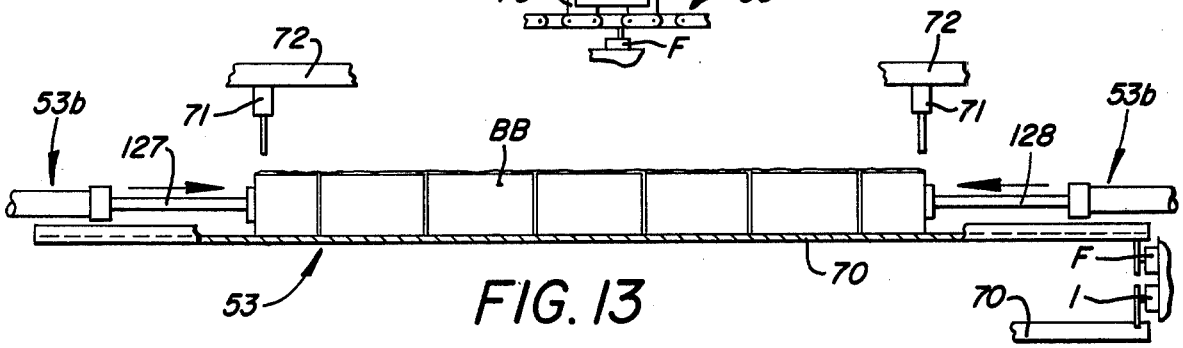
FIG. 13 shows the completed bonded course in the associated pair of guides of the course-forming conveyor being centered on the guide conveyor by opposed pushing rams.
Figure 34:
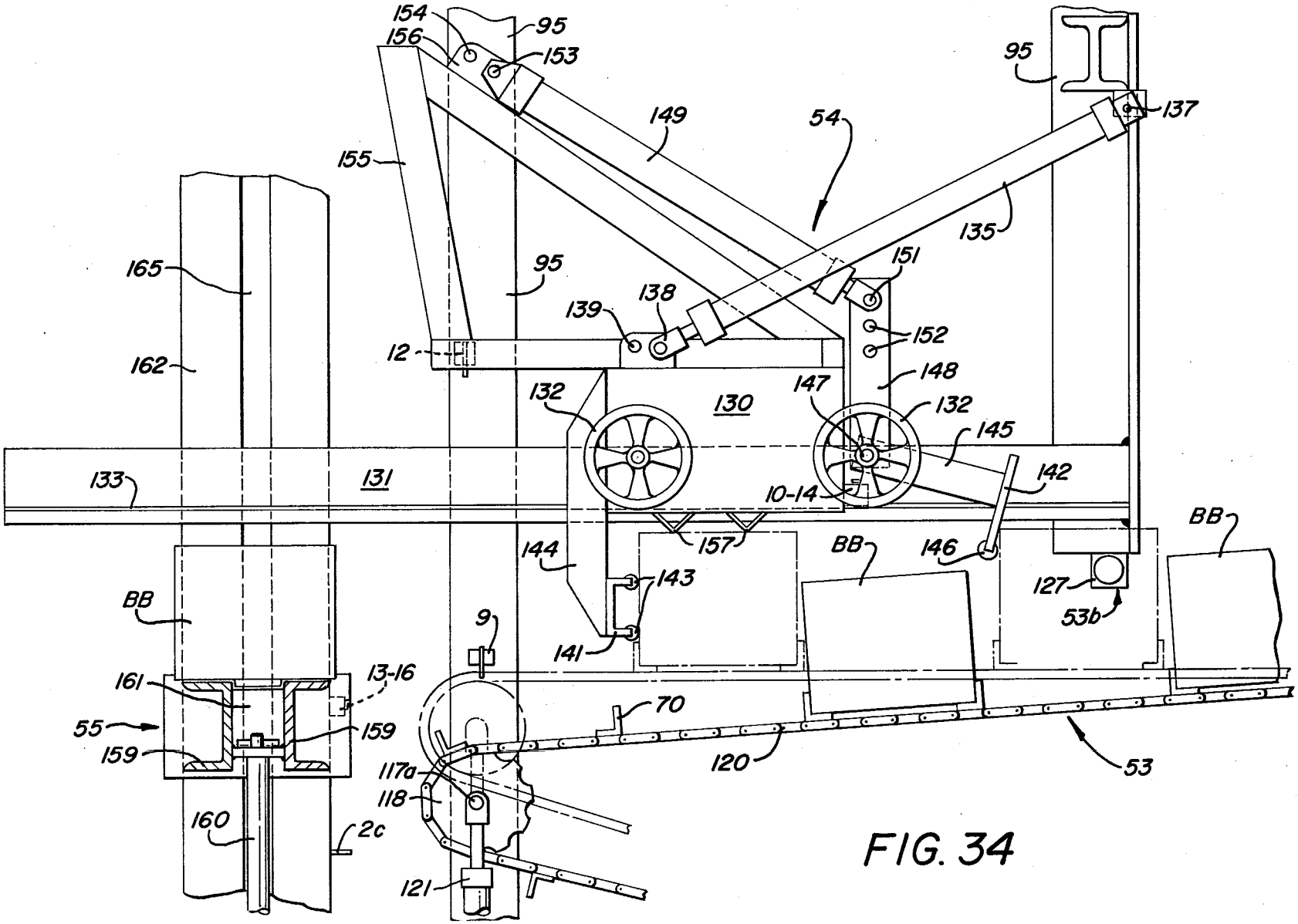
FIG. 34 is an end elevational view, taken from the position indicated at line 34—34 of FIG. 19, of the transfer unit before it clamps or grips the previously-formed course and, also showing one of the ram units which raise and lower the rear end of the guide-supporting conveyor, the conveyor being shown in full lines in lowered position.

This advancing movement of the carriage, the first clamp 1*a* is actuated by the timer PT250 to grip the leading block as shown in FIG. 6. As the carriage continues to advance or move to the left, as indicated in FIG. 7, the first block advances with it and the second clamp 2*a* then clamps the second block, the clamps moving to the successive blocks, which are stationary until they are clamped. Switch 2–7 is tripped successively by the clips 2*b* to 7*b* as the carriage 52 moves to the left. As shown in FIG. 8, the successive clamped blocks are moved along the conveyor section 51*b* until they contact a turning or tilting roller 66, disposed just ahead of the section 51*b*, to rotate or tilt the blocks 90° to a flat horizontal position with their bottom edges resting on a pair of aligned guides 70 of the conveyor 53. The carriage 52 picks up the blocks in spaced relationship to permit this rotation of the blocks. After all the clamped blocks of the row have moved onto this pair of guides, as shown in FIG. 9, the carriage 52 will have moved to the position at the extreme left and engage switch 8 and 11, which operates to stop the carriage in this over-run position with the blocks spaced as shown in FIG. 9. The switch 8 and 11 also operates to raise the conveyor 53 which engages the limit switch 9, carried by the frame 95 (FIG. 34). Opening or release of clamp 1*a* also results in actuation of block stop 51*d* to stop the next row of blocks on conveyor section 51*b* and to lower lift 51*e*. It also results in actuation of a pusher 53*a* to push the blocks of the spaced row in a reverse direction until their coated ends are in contact, as shown in FIG. 10, causing them to adhere. Pushers 53*b* are simultaneously actuated to act on the preceding course in guides 70 as shown in FIG. 13.

Figure 11:
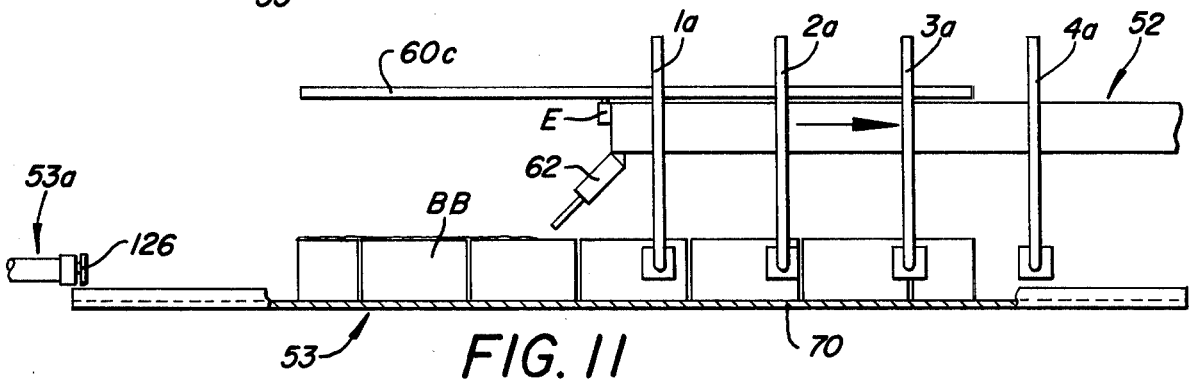
FIG. 11 shows the return movement of the carriage to the right over the course of stationary bonded blocks and the simultaneous coating of the top edges of the blocks with the adhesive binder.
Figure 12:
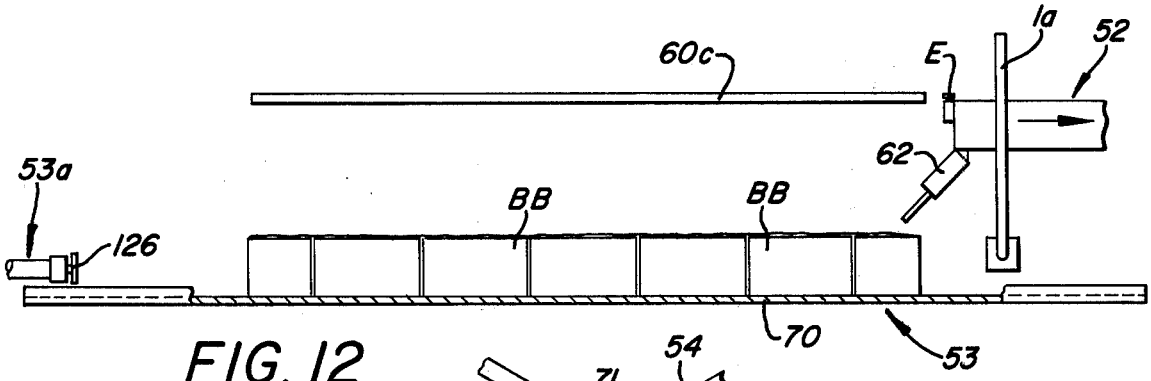
FIG. 12 shows the completion of the coating of the top edges of the course as the carriage continues its return movement.
Figure 14:
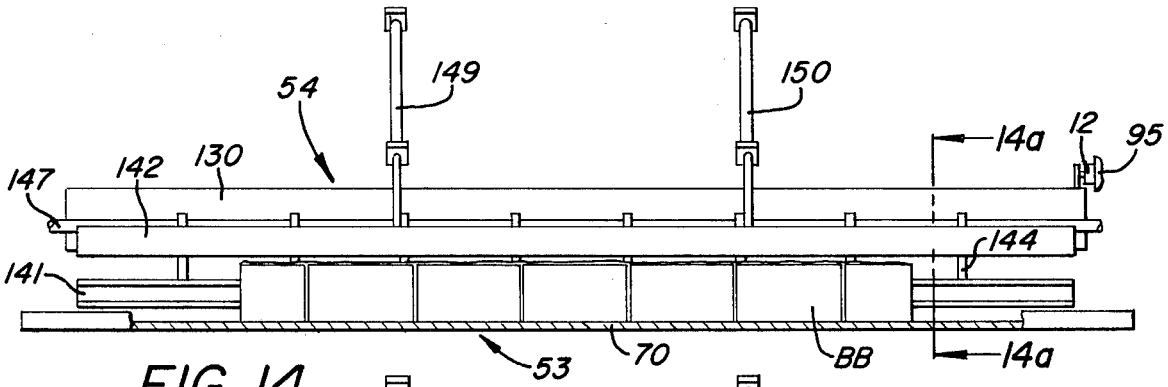
FIG. 14 is a schematic view showing the centered course of bonded and coated blocks moving into association with the transfer unit for transfer to the elevator.
Figure 15:
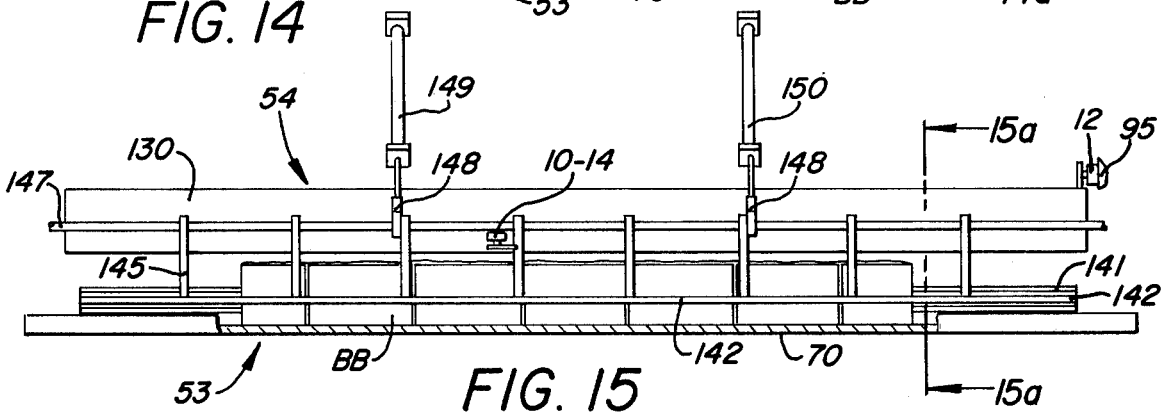
FIG. 15 is a view similar to FIG. 14 showing the bonded block course clamped or gripped by the transfer unit.
Figure 16:
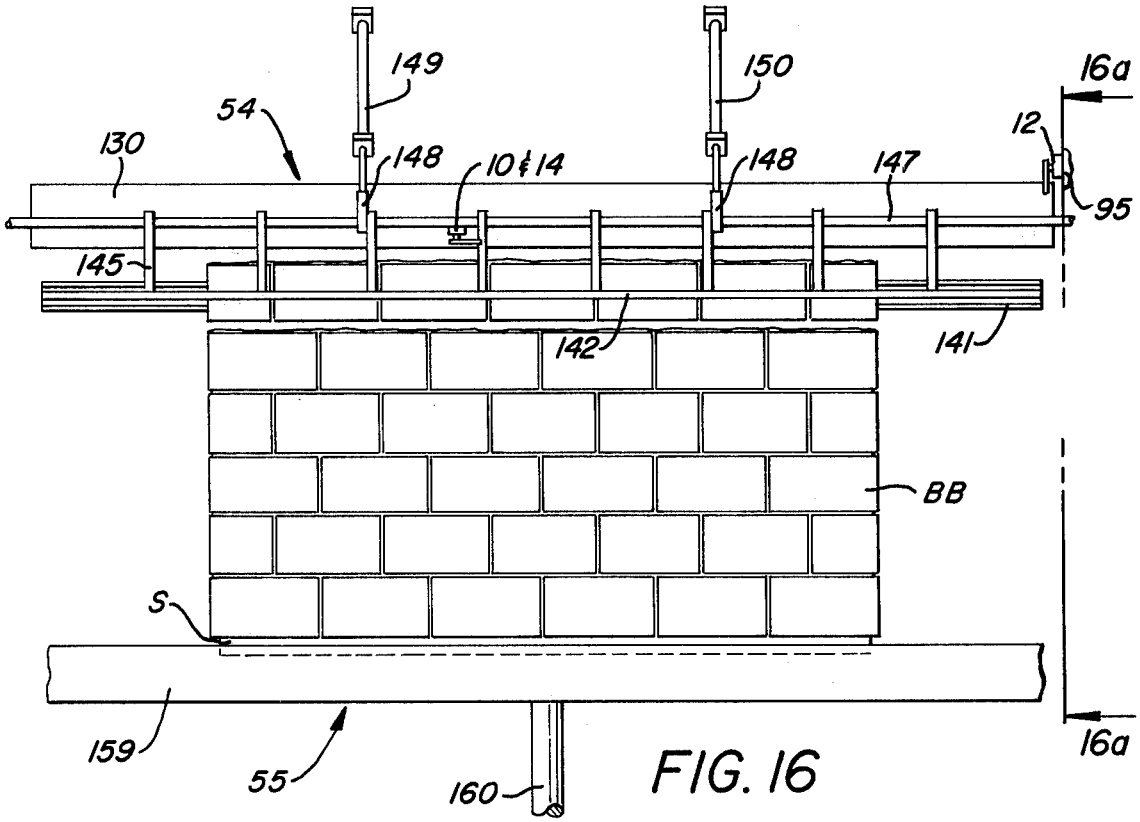
FIG. 16 is a rear elevational view showing the transfer unit with the last-formed course moved over the intermittently lowered elevator, the elevator having previously-formed courses laid thereon, the last-formed course on the transfer unit being spaced slightly above the previously-laid course on the elevator.
Figure 17:
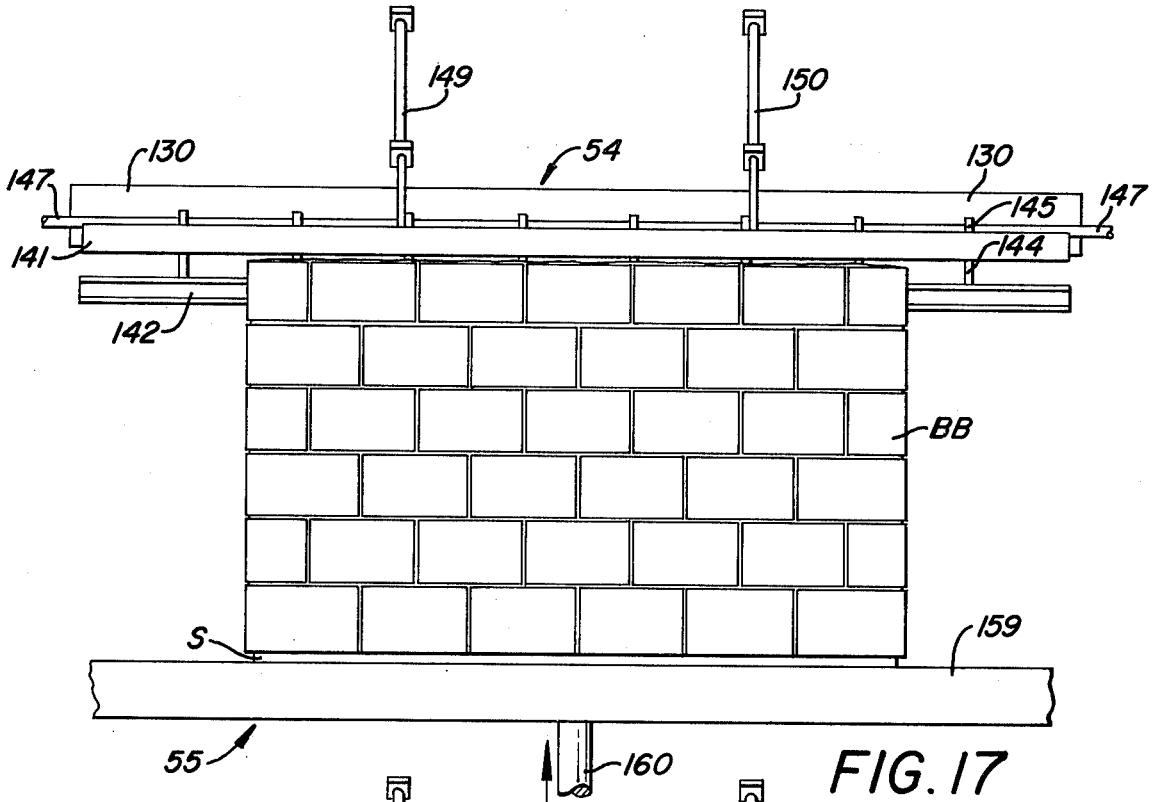
FIG. 17 is a view similar to FIG. 16 but showing the last-formed course released by the transfer unit onto the uppermost course of the partially completed panel on the elevator, which as been moved upwardly into bonding engagement therewith by slight upward movement of the elevator.
Figure 18:
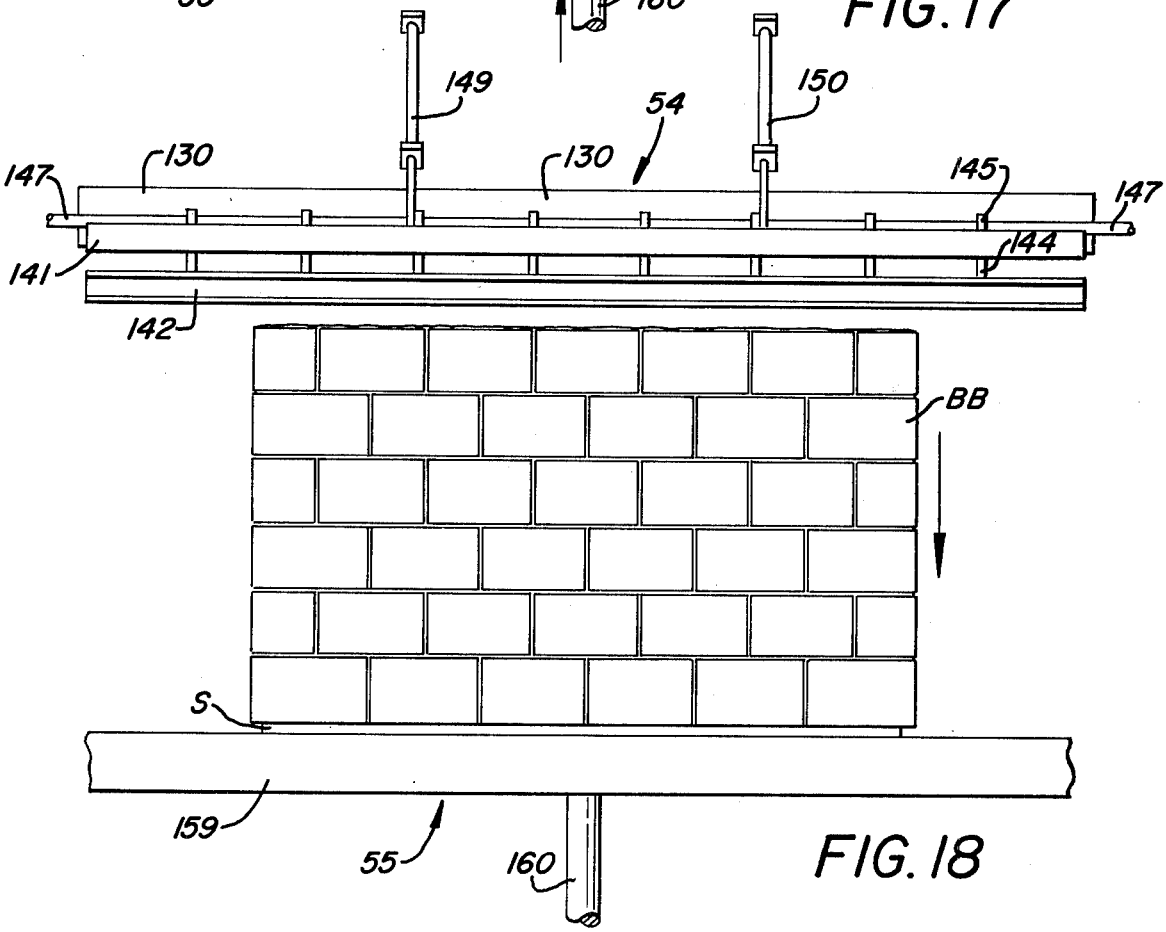
FIG. 18 is a similar view showing the elevator moving downwardly to a position to receive the next-transferred course.
Figure 24:
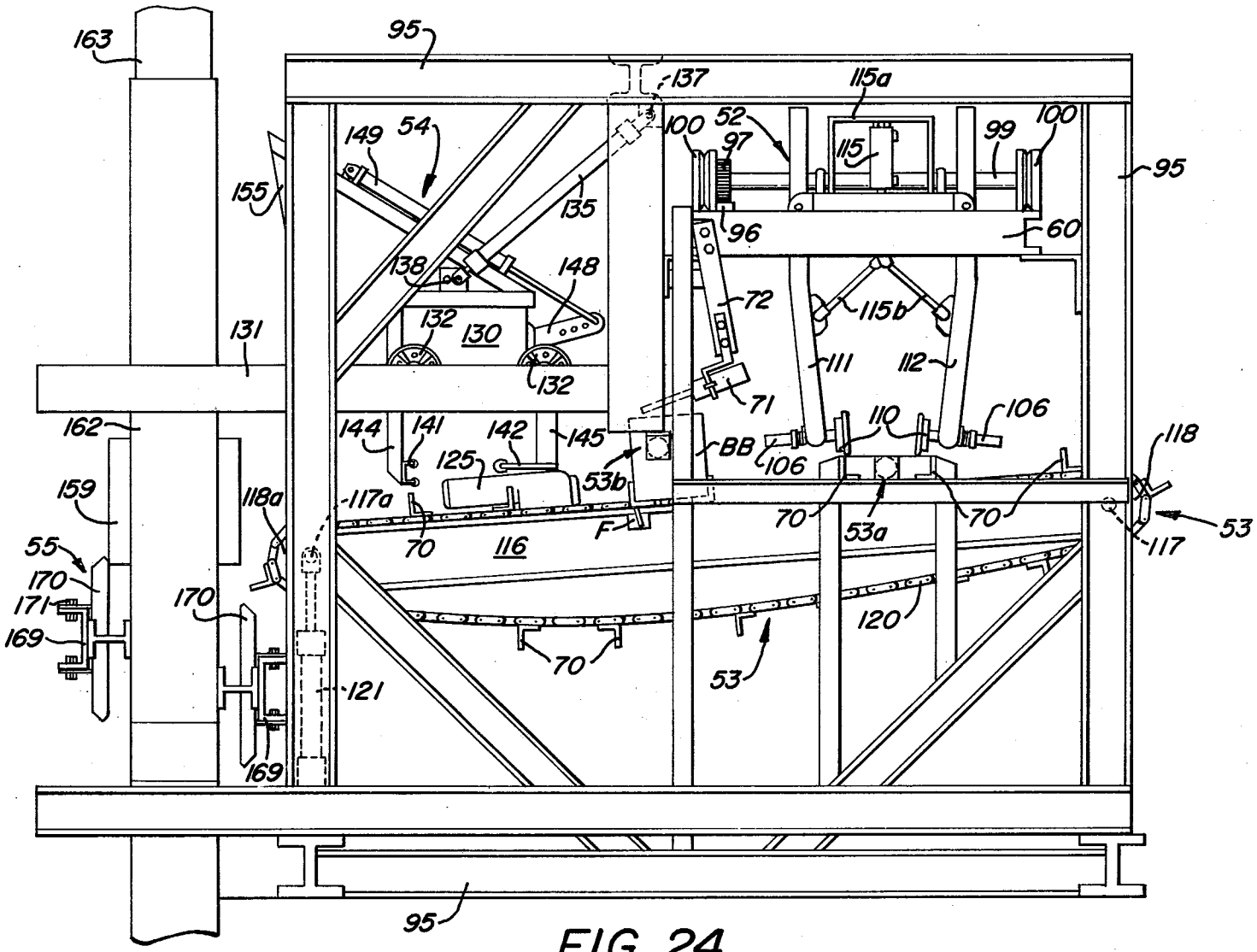
FIG. 24 is a side elevational view of the machine showing mainly the guide-carrying conveyor transfer unit and elevator.
Figure 25:
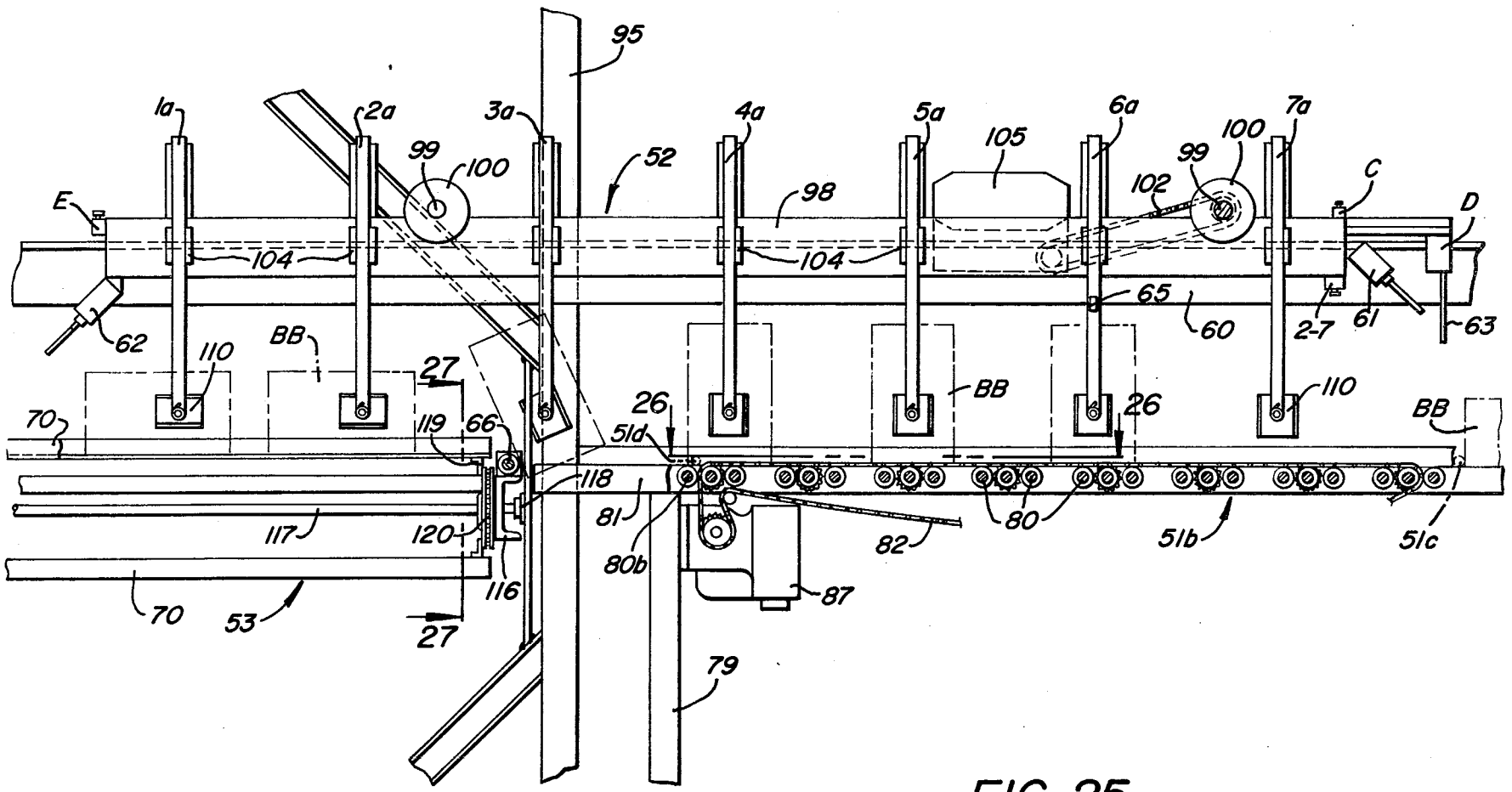
FIG. 25 is an enlarged front elevational view of the machine adjacent its inlet end showing mainly the in-feed conveyor, the reciprocal carriage and the guide-carrying conveyor.
Figures 35, 35A:
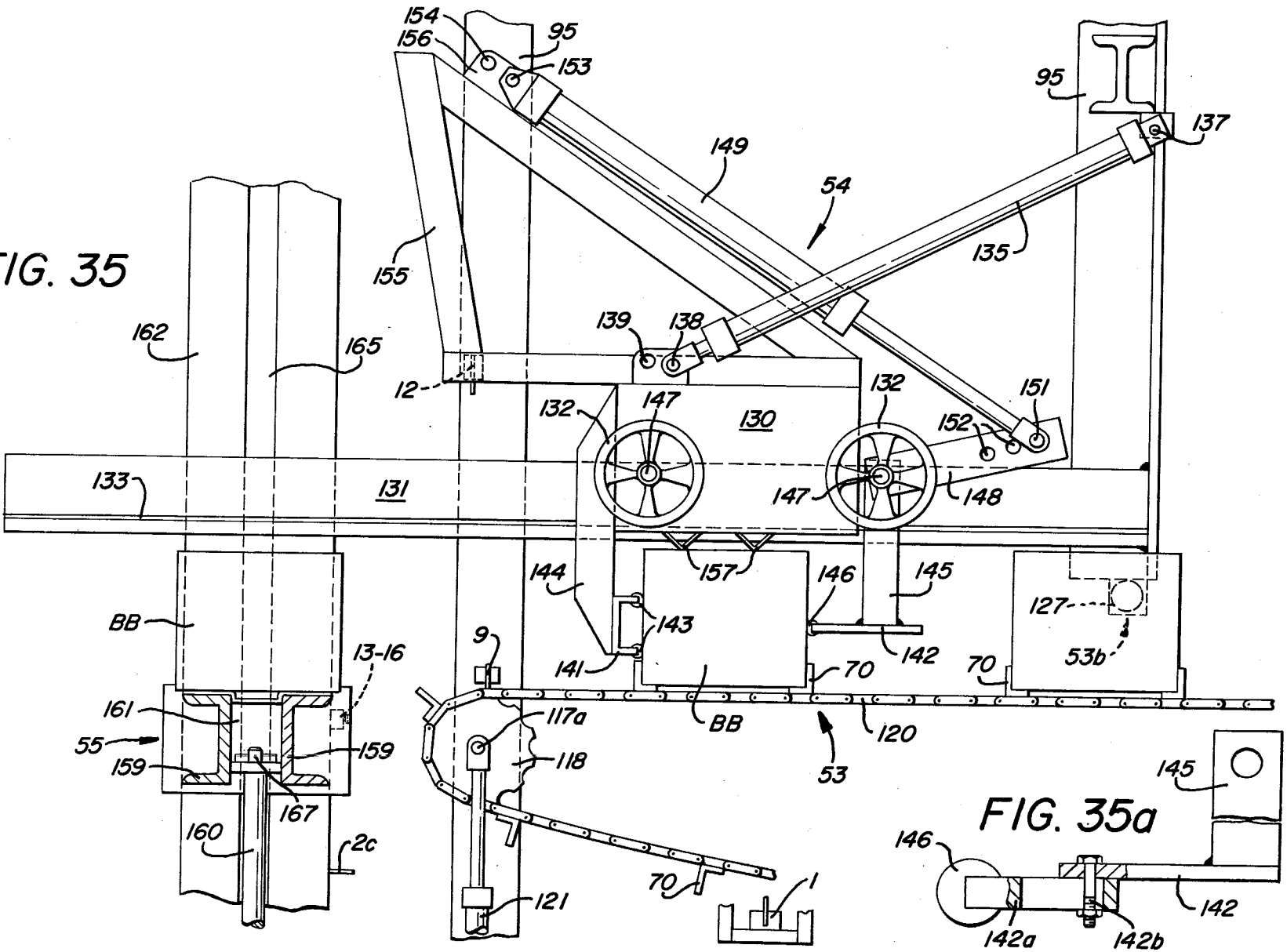
FIG. 35 is a similar view showing the transfer unit clamping the course while it is still in the conveyor guides with the conveyor in raised position.
FIG. 35*a* shows a modification of the movable transfer clamp member for adjustment of it to contact different size blocks.

The carriage is now moved to the right and at this time the switch E, mounted on carriage 52, is engaged with the member 60*c* to activate the flow gun 62, as shown in FIG. 11, so that it will coat the top edge of the course of blocks supported in guides 70, and when the switch moves off the member 60*c*, the flow gun is deactivated as shown in FIG. 12. The conveyor 53 is now moved one step to the rear to align the next pair of guides 70 with the conveyor 51 and to move the previously formed course of blocks between the pair of opposed ram-controlled centering pushers 53*b* which are activated by the timer to center the adhered course of blocks on the pair of guides 70 as shown in FIG. 13. The conveyor 53 ultimately moves a course of formed blocks by intermittent movement of the conveyor into a position where it may be picked up by the transfer unit 54 as shown in FIG. 14 and 14*a*. Rearward movement of the conveyor is stopped by engagement of one of the guides at the lower side of the conveyor 53 engaging a switch 1 fixed therealong as shown in FIGS. 13 and 35. Raising and lowering of the rear end of conveyor 53 is necessary to facilitate operation of the transfer and is under the control of a switch 9 engaged by a guide 70. During this movement the top edges of the respective end blocks are subjected to a pair of opposed single nozzle guns 71 which are fixedly mounted above the conveyor 53 by arms 72 depending from the carriage support frame as shown in FIGS. 13 and 13*a*. These guns are controlled by a switch F carried by one of the beams 116 of the conveyor as shown in FIG. 24, and engaged by the blocks as the successive courses of blocks are carried rearwardly by the conveyor. Then by operation of switch 10 and 14 shown in FIG. 15 and 15*a*, the course of blocks is clamped by the transfer unit 54 and is moved to the position shown in FIG. 16 and 16*a* to locate the course which it carries over the courses of blocks previously laid on the elevator 55 but slightly spaced above the uppermost course. As the transfer unit 54 moves over the elevator it engages a switch 12 fixed on the frame 95 to actuate elevator 55 as shown in FIG. 17, to raise it slightly and then stop it so as to cause the upper course to engage and adhere to the next lower course. As shown in FIG. 16*a*, switch 13 and 16 is fixed on the elevator and engages clips 1*c* to 19*c* carried on the elevator support posts. When the switch 13 and 16 engages one of the clips 1*c*–19*c*, it operates to open the transfer clamp which then again operates switch 14 to initiate lowering of the elevator 55. At the same time the feeder carriage 52 is returning over conveyor 51 and lug 65 again engages switch 15 stopping the carriage which starts guide carrying conveyor 53 which moves to the next incremental position.

The elevator is lowered sufficiently to receive the next course of block and, at the same time, conveyor 53 is advanced to actuate switch 1 which results in stopping of conveyor 53 and starts the feeder carriage 52 to the left again in the next cycle. When the panel is completed by laying all the desired courses on the elevator 55, the machine is stopped to permit removal of the concrete block panel that has been formed by the automatic sequential operation of machine.

To facilitate handling, the panel may include a lower supporting member which is shown as a channel S in FIG. 18*a*. This channel will be placed on the elevator 55 and will receive the first course of blocks. After all the courses are laid a plate P may be rested on the top course and rods R may be passed downwardly through openings in the plate which align with the vertical channels in the blocks. These rods will be extended down through a slot in the elevator 55 and clamping nuts N applied. Preferably, the upper ends of the rods will be extended above the plate P and will have a double heat T by means of which the panel can be lifted and handled, such as with a forklift, a chain or cable hoist.

The path of one course of blocks through the machine has been described by general reference to the various units in FIGS. 1 to 18. The movement of the course having only the full blocks will be identical except that clamp 7*a* will not clamp a block. The details of those units will now be described with reference to FIGS. 19 to 39.

The conveyors 50 and 51 are of similar construction being of the roller type and, therefore, the details of the conveyor 51 only will be described. The conveyor 50 is of Y-form as described and as shown in FIG. 20*a*, and includes the previously described sections 50*a*, 50*b*, and 50*c* which are independently driven by the respective motors 76, 77 and 78. Guide rails 50*d* are supported over the rollers of the conveyor and are arranged to cooperate to provide two separate guide channels on the sections 50*a* and 50*b* merging into a common channel on the section 50*c*. These conveyors are supported at the proper level on stands 79 as indicated best in FIG. 19.

Figure 21:
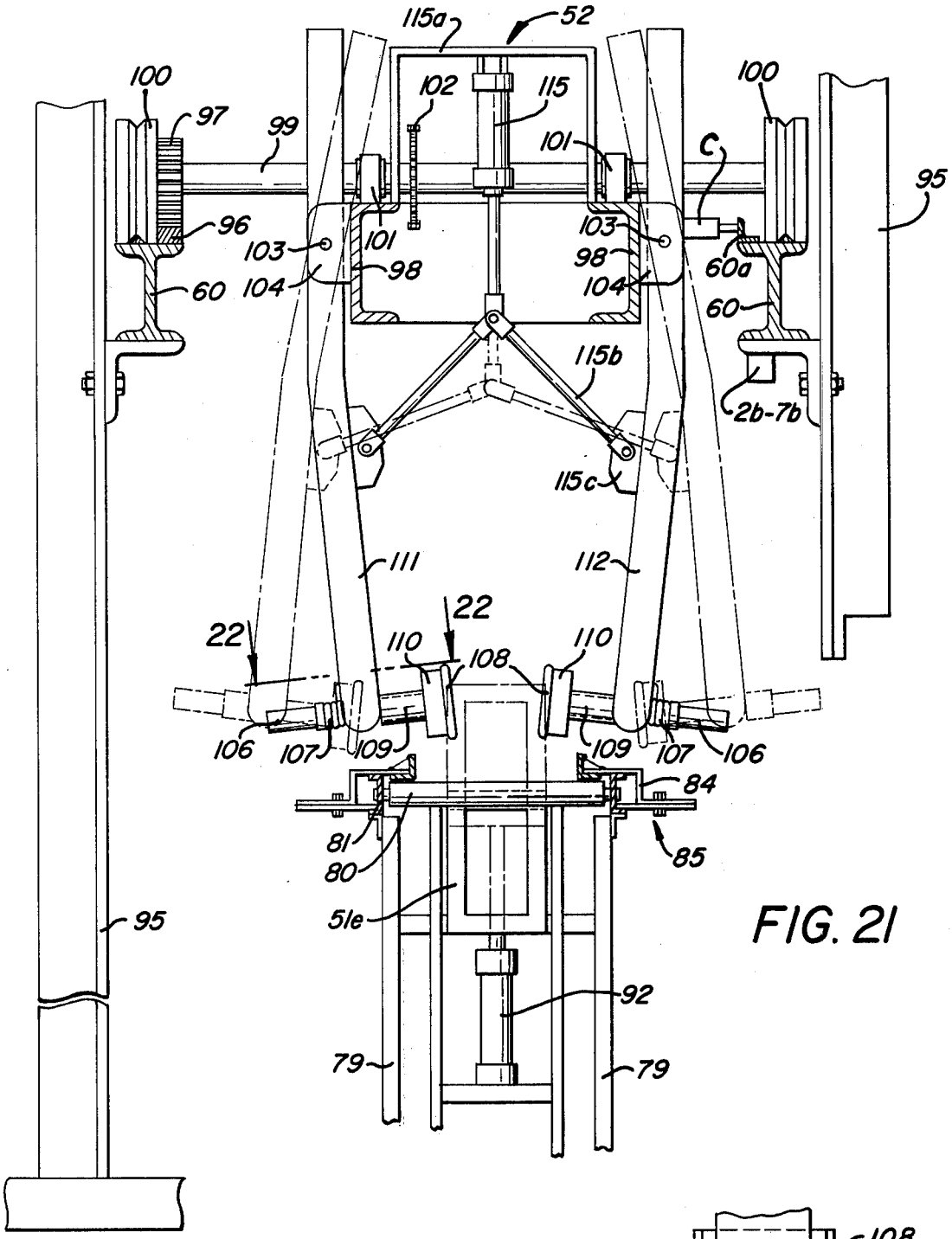
FIG. 21 is an enlarged transverse vertical sectional view taken at line 21—21 of FIG. 20 through the reciprocal clamp carriage, showing the rotatable clamp jaws and automatic reversing means.
Figure 26:
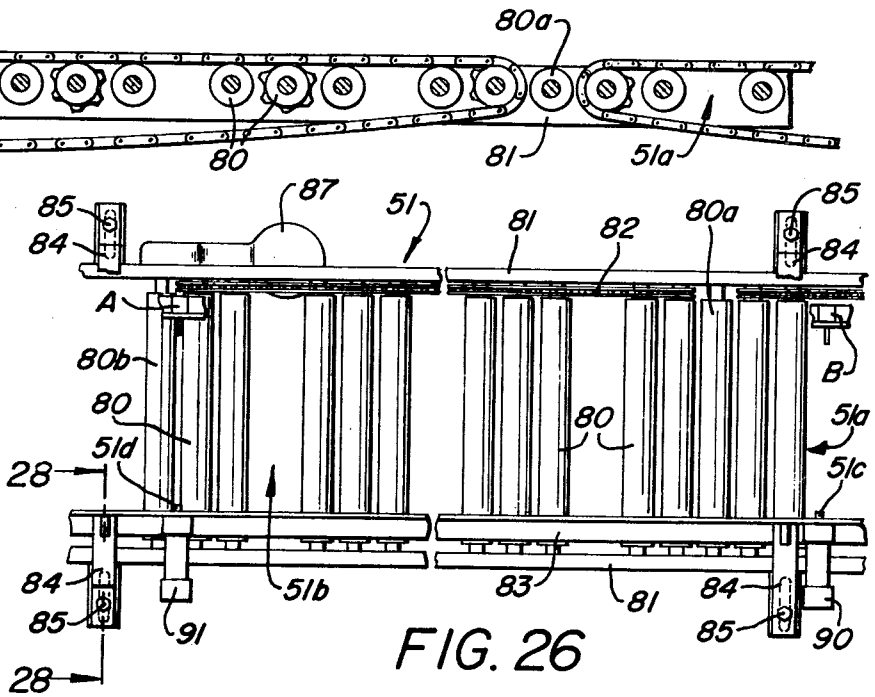
FIG. 26 is a horizontal sectional view taken along line 26—26 of FIG. 25, showing a section of the in-feed conveyor.
Figure 28:
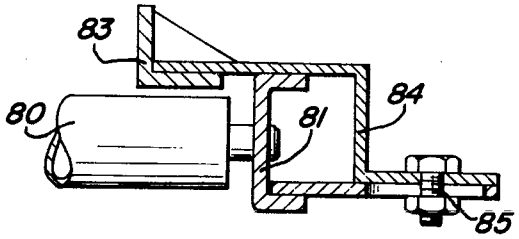
FIG. 28 is an enlarged vertical sectional view taken along line 28—28 of FIG. 26 showing means for mounting and adjusting the guide rails of the in-feed conveyor.
Figure 29:
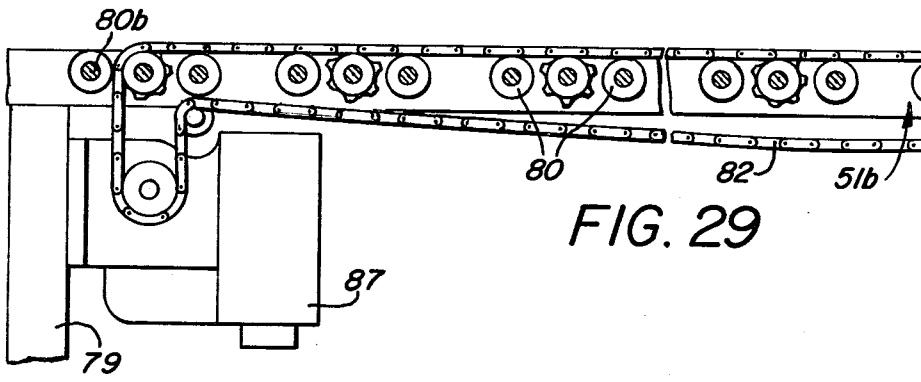
FIG. 29 is a side elevational view of the in-feed conveyor section showing the driving means therefor.
Figure 27:
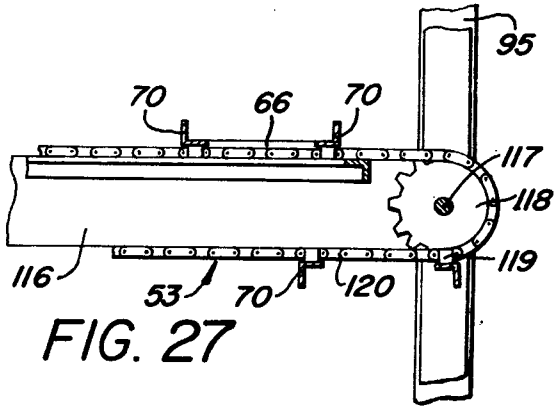
FIG. 27 is a vertical sectional view taken along line 27—27 of FIG. 25 through the guide-carrying conveyor.
Figures 30, 37A:
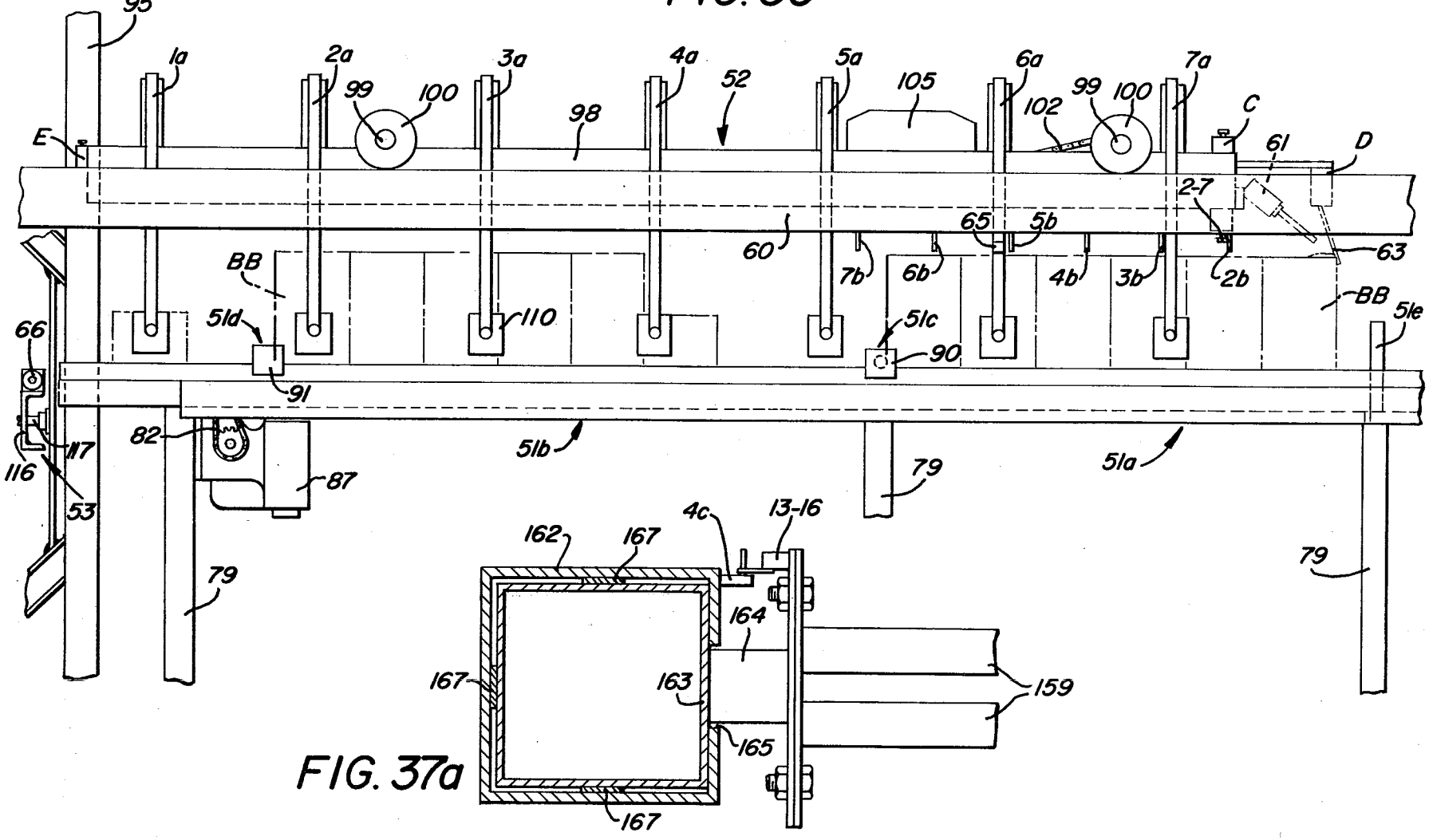
FIG. 30 is a side elevational view of the reciprocal clamping feeder and flow gun carriage.
FIG. 37*a* is an enlarged horizontal sectional view taken along line 37*a*—37*a* of FIG. 37.
Figure 31:
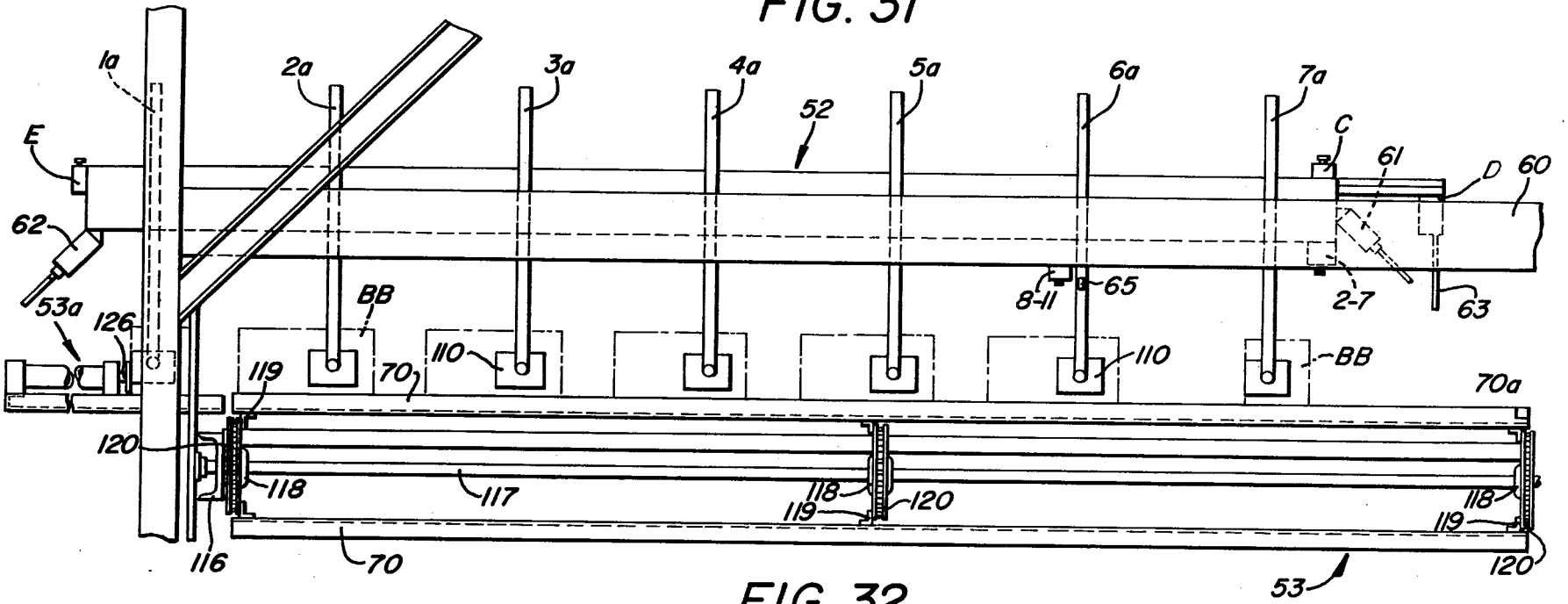
FIG. 31 is a front elevational view showing the front end of the course-forming and guide-supporting conveyor with the feeder carriage moved into cooperation therewith.
Figure 32:
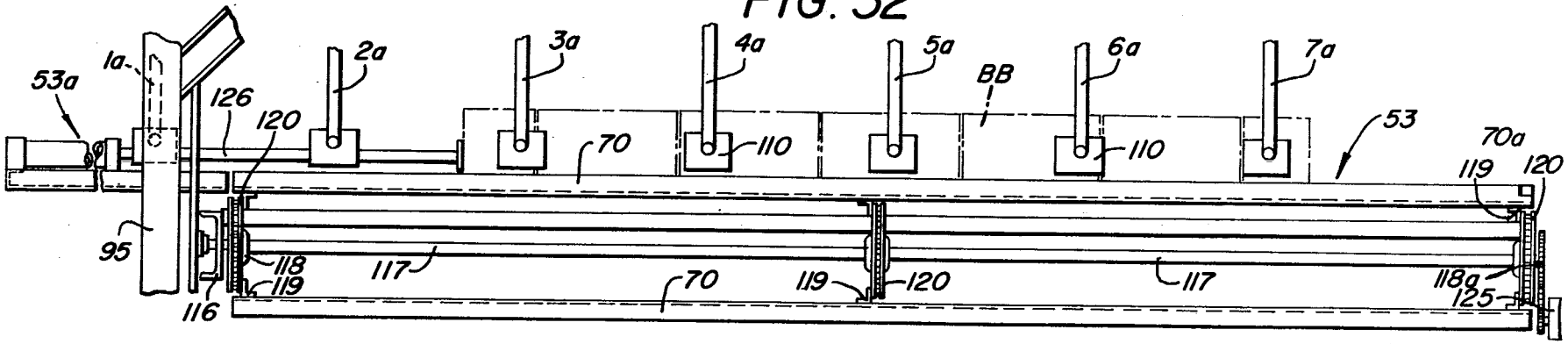
FIG. 32 is a view similar to FIG. 31, showing the ram unit for pushing the blocks of the course together after release by the clamps of the carriage.

The conveyor 51 is shown best in FIGS. 25, 26, 28 and 29. It consists of the supporting stand 79 which supports the rollers 80 transversely and longitudinally by means of parallel support rails 81. The rollers 80 are arranged in groups of three, the center roller of each being driven by means of a chain and sprocket drive 82 at one side of the conveyor ahead of and behind, and the roller, the center roller being freely rotatable at all times. Longitudinally extending parallel guide rails 83 are provided at each side of the conveyor over the rollers and are supported by brackets 84 which are adjustably supported by bolt and slot connections 85 so that the spacing of the rails can be varied in accordance with the use of different size blocks. The conveyor section 51*a* is driven independently by an electric motor drive unit 86 and the section 51*b* is driven by a similar motor drive unit 87. A freely rotatable roller 80*a* (FIGS. 26 and 29) is mounted between conveyor sections 51*a* and 51*b* and similar rollers 80*b* (FIGS. 25, 26 and 29) are mounted between the other end of conveyor section 51*b* and conveyor 53. As previously indicated, the block-stop units 51*c* and 51*d*, cooperating with the conveyor each includes a pin or rod which is projected across the conveyor and which is actuated by a ram. As shown in FIG. 26, the ram for stop 51*c* is designated 90 and the ram for stop 51*d* is designated 91, the ram 90 being located close to the loading end of conveyor section 51*a* and the ram 91 being located close to the leading end of the conveyor section 51*b*, each ram being carried in horizontal inwardly-directed position by one of the rails 81. The block-lift unit 51*e* is actuated by a ram 92 which is vertically disposed below the conveyor section and is carried by the stand 79 (FIG. 21). The ram 92 is located below the conveyor section 51*a* at a suitable distance behind the ram 90, as indicated in FIGS. 19 and 20.

The stand 79 of the conveyor 51*b* is attached at its leading end to the main frame 95 of the machine, as shown in FIGS. 19 and 20, and it will be noted that this frame extends forwardly and rearwardly. The frame does have the carriage support beam 60 extending laterally therefrom over the conveyor 51, being horizontally disposed at a suitable level above the conveyor 51, these beams being parallel and also extending over the conveyor 53. These beams serve as guide rails for supporting the carriage 52 for reciprocating movement. One of the rails 60 carries a longitudinally extending rack 96 (FIG. 21) which is engaged by a driven pinion 97 on the carriage 52 and the other rail 60 carries the horizontally extending angles 60*a* and 60*c*, previously referred to, which cooperate with switches C and E on opposite ends of the carriage that control the flow guns 61 and 62 on the carriage 52. The rack 96 extends substantially the full length of the beam 60 which carries it but the angle member 60*a* extends only over conveyor section 51*a* and the angle member 60*c* extends only over the conveyor 53. The switch E is fixed to the carriage at the left end for engagement with the angle 60*c* and the switch C engages angle 60*a* as indicated previously. This member 60 also carries (FIG. 21) the clamp-actuating clips 2*b* to 7*b* disposed therealong at longitudinally spaced intervals for cooperating with switch 2–7 on the carriage.

Figure 22:
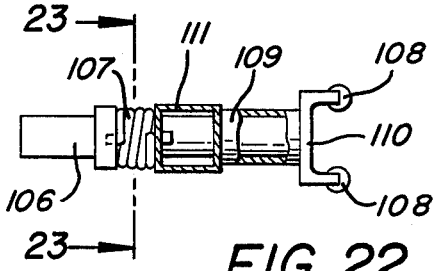
FIG. 22 is a horizontal sectional view taken along line 22–20 of FIG. 21, showing details of the clamp reversing means.
Figure 23:
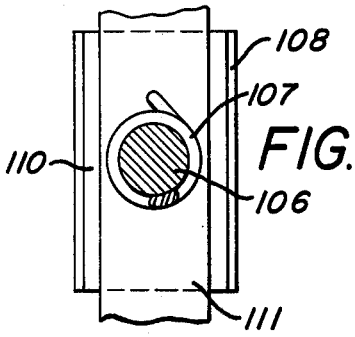
FIG. 23 is a vertical sectional view taken along line 23—23 of FIG. 22.

The details of the carriage 52 are shown in FIGS. 21 to 25 and it will be noted that it comprises a frame which includes the longitudinally extending parallel beams 98. These beams have a pair of forward and rearward axle-units 99 rotatably carried by bearings 101 on the top edges thereof and which extend transversely beyond the beams. These axles carry the four grooved support rollers 100 which engage with guide strips on the top edges of the beams 60. The axle 99, which carries the pinion 97, is driven by a sprocket and chain drive 102 (FIG. 25) from an electric motor 105 supported between the beams 98. As previously indicated, the carriage 52 is provided with the block-clamp units 1*a* to 7*a* for clamping successive blocks supported on the conveyor 51*b* and each of these units includes a pair of clamp arms 111 and 112 as shown best in FIG. 21. The arms 111 and 112 are disposed outside of the respective beams 98 and are pivoted by rods 103 to lugs 104 projecting outwardly from the beams. The lower end of each clamp arm has a shaft 106 rotatably mounted therein and cooperating with the shaft is a torsion spring and stop unit 107 (FIGS. 22 and 23). Each shaft 106 carries on its inner end a clamp member 110 which is in the form of a channel that has compressible strips 108 on its edges for yieldingly engaging the blocks. A spacer sleeve 109 is preferably provided on the shaft 106. This arrangement provides for yielding of each clamp member to rotation through 90° under torque and then automatic return to its original position when the force is released. If blocks of different widths are to be gripped, the pairs of spacers 109 may be removed and replaced with spacer sleeves of different axial extents.

Each of the pairs of arms 111–112 is contracted into block-clamping position or expanded into block-releasing position by means of a ram 115 which is supported in vertical dependent position by an inverted U-shaped bracket 115*a* carried by the beams 98 at the upper edges thereof. The piston rod of this ram is pivotably connected at its lower end to toggle links 115*b* which, in turn, are pivoted to lugs 115*c* on the respective arms 111 and 112. Thus, actuation of the ram 115 will cause spreading or contraction of the pair of arms and the clamp members 110 carried thereby.

The course-forming and supporting conveyor 53 extends forwardly and rearwardly of the main frame 95, at the leading end of conveyor 51 and is shown best in FIGS. 19, 20, 24, 25 and 27. It will be noted that these two conveyors are disposed at a right angle relatively (FIG. 20) and that the block-tilting roller 66 (FIGS. 25 and 30) is supported at the edge of the conveyor 53 just beyond the free rollers 80*b* carried at the leading end of the conveyor 51*b*. There is a space between the leading roller 80*b* and the tilting roller 66 and the upper surface of the roller 66 is slightly above the level of the rollers 80*b*. The conveyor 53 comprises a frame which includes a pair of main support beams 116 disposed in parallel relationship and extending forwardly and rearwardly of the frame 95 to which they are pivoted by means of an idler pivot shaft 117 rotatably carried by pivots 118 at the forward side of the frame. It will be noted (FIG. 25) that beam 116 at the side conveyor 53 adjacent the conveyor 51*b* is the one which carries the freely rotatable roller 66 on its top edge. A similar roller shaft 117*a* is provided at the rear of the conveyor 53, as shown in FIG. 35, but this shaft extends only between the beams 116 and is journaled therebetween. The conveyor includes three laterally spaced endless sprocket chains 120 which are carried by three properly spaced sprockets 118*a* keyed on each of the shafts 117 and 117*a*. The chains carry pairs of the previously-mentioned block-guides 70 which are in the form of angle members that are preferably secured to the chains 120 by means of removable angle clips 119. The pairs of the angle guides 70 are disposed in parallel relationship transversely of the chains, the angles of each pair being spaced apart properly to receive the particular size blocks being laid. It will be noted in FIGS. 31 and 32 that one of each pair of guides is formed with a notch 70*a* at the one end so that switch 1 will be actuated only once for each pair of guides. However, the spacing can be varied properly if different size blocks are used. The conveyor 53 is driven by means of an electric motor 125 which is carried by one of the beams 116 and drives the chain 120 at that side. It will be apparent that the conveyor 53 can pivot for vertical movement about the forward pivot shaft 117. To produce this vertical movement the rams 121 and 122 are provided as indicated in FIGS. 19, 24, and 34 to 36. The rams 121 and 122 are supported upright by the frame 95, at the respective sides thereof, with the upwardly extending piston rods thereof being pivotally connected to the shaft 117*a*. Thus, it will be apparent that actuation of the rams 121 and 122 will result in vertically raising and lowering the rear or unloading end of the block-guide conveyor 53, since it is free to pivot about the pivot shaft 117 disposed at the forward or loading end thereof. A limit switch 9 is mounted on the rear portion of the frame 95 (FIGS. 34 to 36) for engagement by the conveyor 53, as it is raised to control movement of the transfer unit 54.

Figure 33:
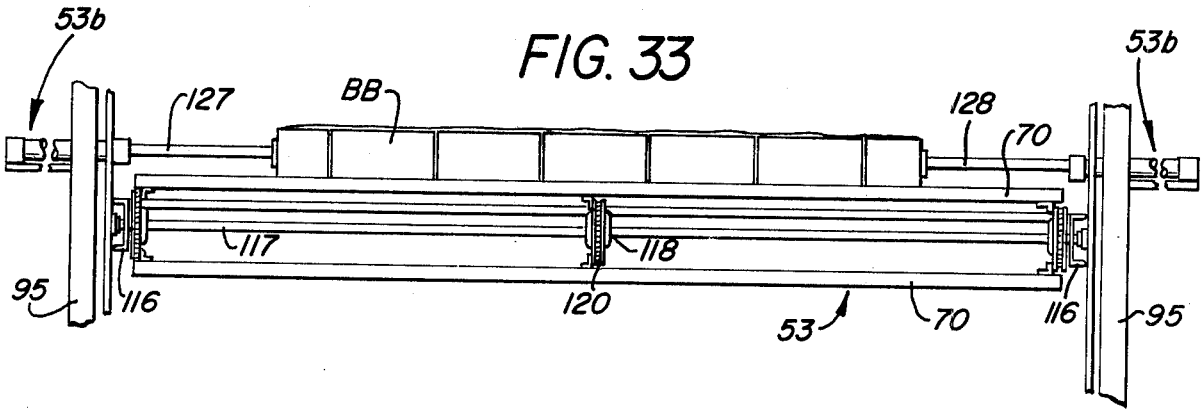
FIG. 33 is a horizontal sectional view taken on line 33—33 of FIG. 20 showing the opposed ram units for centering the course of blocks on the guide conveyor.

As previously indicated, the block pusher 53*a* and the pair of cooperating block pushers 53*b* are provided in cooperation with the conveyor 53, all of these pushers being ram-operated. The pusher 53*a* is disposed at the forward end of the frame 95 and is aligned with the centerline of the conveyor 51. It includes a ram 126 which is shown best in FIGS. 20, 24, 31 and 32 and which is supported by the frame 95 at a suitable level so that when the ram is actuated, its piston rod will be projected over the upper run of the conveyor 53. The pusher is shown in its withdrawn position in FIG. 32. The pushers 53*b* are similar and include the respective rams 127 and 128 as shown in FIGS. 20, 24 and 33 to 36. These rams 127 and 128 are supported by the frame 95 in axially-aligned horizontal positions at opposite sides of the conveyor 53 at a suitable level so that when the piston rods of the rams are extended, as indicated in FIG. 13 and 33, they will extend over the upper run of the conveyor 53.

Figure 36:
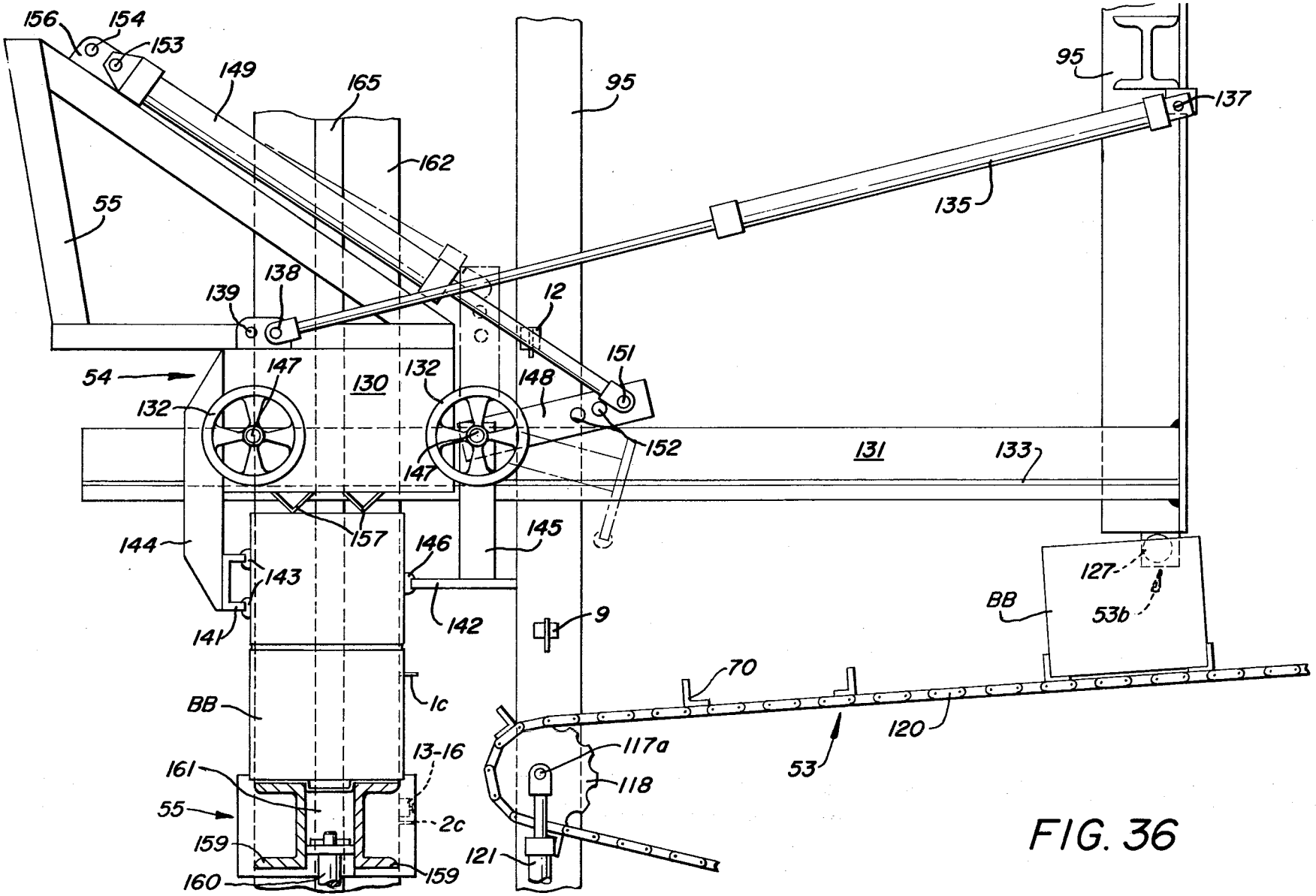
FIG. 36 is a view similar to FIG. 35 showing the transfer unit with the clamped course moved over the elevator.

The transfer unit 54, as previously indicated, is supported for forward and rearward reciprocation at a suitable level in a horizontal plane above the conveyor 53 and the elevator 55. This transfer unit is illustrated best in FIGS. 14*a*, 15*a*, 16*a*, 19, 20, 24, and 34 to 36. The unit comprises a box-like body 130 which extends transversely of the frame 95 which is provided with the forwardly and rearwardly extending support beams 131. These beams are laterally spaced and extend in parallel relationship at a suitable level above the rear portion of the conveyor 53 and over the elevator 55. The body 130 has rotatably mounted at its four corners the grooved support rollers 132 which engage with rails 133 (FIGS. 20 and 36) carried by the beams 131 at their inner sides. Thus the body 130 can travel forwardly and rearwardly along the beams 131. To reciprocate the transfer unit frame 130 on the beams, a pair of rams 135 and 136 are provided at the respective ends of the frame. Each ram unit is pivotally connected at its upper end, at 137, to the upper portion of the frame 95 and at its lower end, at 138, to a lug projecting upwardly from the body 130, provided with a pair of pivot openings as a means of adjustment. It will be apparent that the rams 135 and 136 are in inclined positions at the respective sides of the frame 95 and when retracted, as shown in FIG. 35, the unit 54 is at its forwardmost position over the rear portion of the conveyor 53. However, when the rams are extended, as indicated in FIG. 36, the transfer unit 54 is at its rearwardmost position over the elevator 55.

The body 130 of the transfer unit is provided with means for clamping a course of blocks carried on the conveyor 53 and consisting of a fixed rearward clamp member 141 and a movable forward clamp member 142 which are of substantially the same longitudinal extent as the body 130. The member 141 is of channel-form, turned inwardly to engage the block and being provided with yieldable block-engaging grooved rubber edges slipped thereon. The member 141 is fixed to the lower ends of vertically-disposed depending support arms 144 which are welded, or otherwise secured, at their upper ends to the rear side of the body at longitudinally spaced positions. The forward movable clamp member 142 is in the form of a single plate which has similar block-engaging grooved rubber edges 146. This member 142 is carried by lever arms 145, which are pivoted to the body 130 at its lower corner, by means of a pivot shaft 147, which also supports a pair of the rollers 132. It will be noted that the arms 145 are disposed at longitudinally spaced intervals along the shaft 147 which is carried by suitable bearings at the front side of the body 130. If desired, the extent of plate 142 can be changed to clamp different size blocks, by the addition of an overlapping plate 142*a* (FIG. 35*a*) connected to plate 142 by pin and slot connections 142*b*. For swinging the arms 145, and the clamp member 142 carried thereby, about the axis of pivot shaft 147, a pair of rocker arms 148 are provided and are keyed to the shaft in spaced positions intermediate its length. These two arms are rocked by the rams 149 and 150. Each of the rams is connected at its lower end to the upper end of an arm 149 or 150 by a pivot connection 151 which can be selectively set in any of a plurality of openings 152 formed therein. Each ram extends upwardly and rearwardly to a pivot point 153 which can be set in either of a pair of openings 154 provided in a lug 156 on an upright triangular forwardly and rearwardly extending support 155 rigidly attached to the body 130 at its upper side at spaced positions. When the arms 149 and 150 are extended, as shown in FIG. 35, the clamp member 142 is swung downwardly into clamping position and when retracted, as shown in FIG. 34 the clamp member is swung upwardly into non-clamping position. It will be noted that the body carries on its lower surface a pair of longitudinally-extending members 157 of inverted V-form for engaging the tops of the clamped course of blocks. The frame 95, at its rear side, carries a limit switch 9 which is engaged when the conveyor 53 is raised to the transfer unit 54. This switch will actuate the rams 149 & 150 of the transfer so as to swing the clamp member 142 into clamping position, as shown in FIG. 35.

Figure 37:
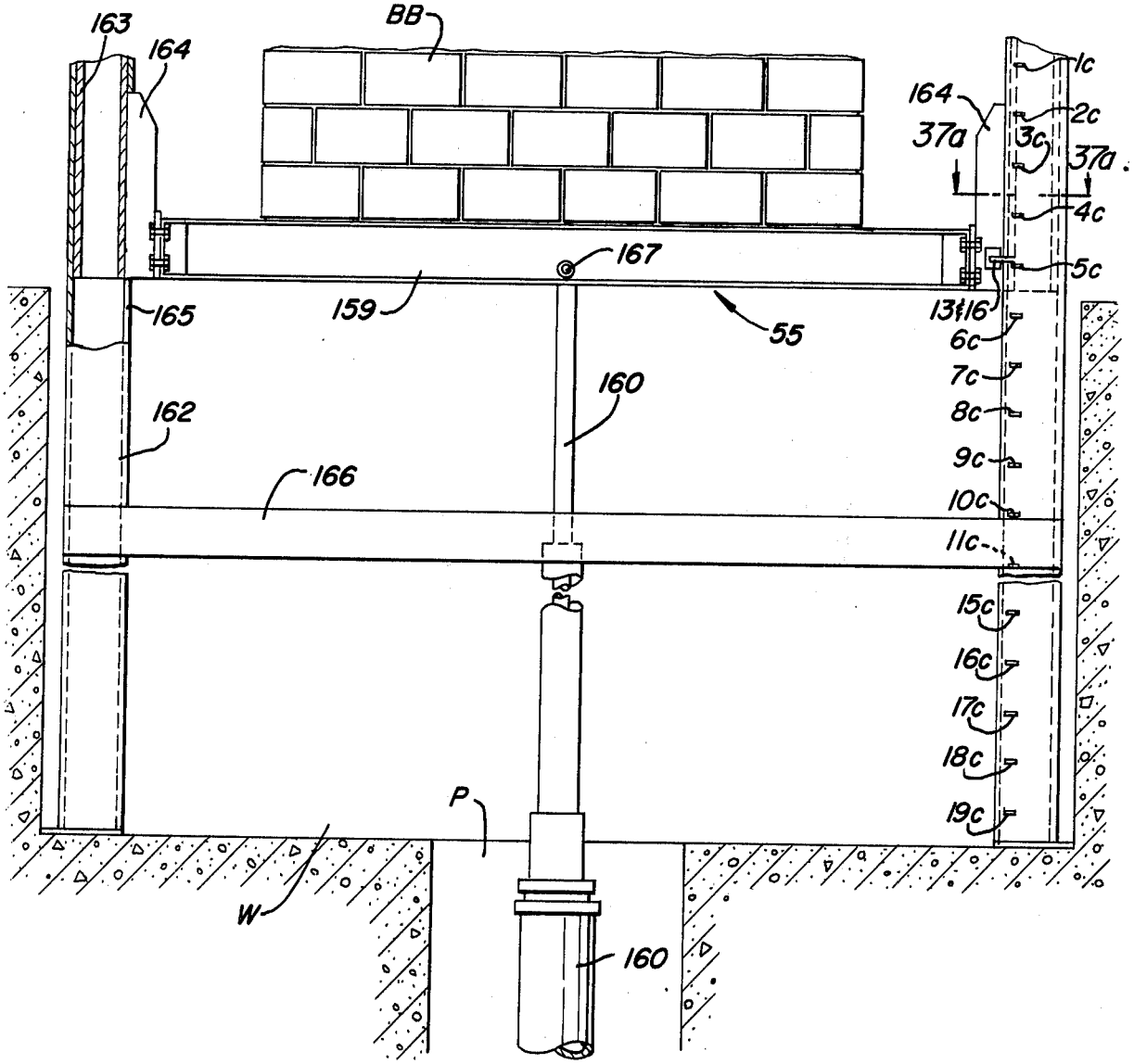
FIG. 37 is a rear elevational view showing mainly the elevator of the machine.

As previously indicated, the successively formed courses of blocks are transferred from the rear end of the guide-carrying conveyor 53 by the transfer unit 54 to the elevator 55 disposed at the rear of the frame 95. This elevator is shown best in FIGS. 19, 24, and 35 to 37 and 37*a*. It comprises a platform 159 which is formed by longitudinal outwardly-turned channel members that are spaced apart to provide a slot 161 therebetween, which will permit passage of the panel tie rods R previously mentioned. This platform 159 is movable vertically by means of a large vertically disposed ram 160 of the telescoping type, which is connected thereto at its upper end at 159, and which is disposed mainly in lower narrow pin P (FIG. 37) which communicates with an upper wider pit W in which the platform 159 can move vertically. Parallel upright platform guide posts 162 also have their lower ends disposed in the pit W and extend upwardly out of the pit. Each post consists of the lower main section 162 and an inner smaller section 163 (FIG. 37*a*) which telescopes therein for vertical sliding movement. Spacer bars 167 are provided, in vertically extending positions, in the gaps between the members 162 and 163 at each of the four sides thereof. A brace 166 extends transversely between the lower sections of the posts and is welded thereto. The channel members of platform 159 are rigidly connected to the respective inner sections 163 by means of vertically extending guide brackets 164 which have tongues that are welded to the sections 163 and which move vertically in slots 165 provided in the larger post sections 162. It will be apparent that extension of the ram 160 will raise the platform 159, as shown in FIG. 37 and retraction of the ram will lower it. The movement of the platform will be guided by the smaller inner post sections 163 sliding in the larger outer sections 162. The one member 159 carries the limit switch 13 and 16 which wll be engaged and actuated by clips 1*c* to 19*c* (FIG. 37) which project from the adjacent face of one of the post sections 162 to control vertical movement of the elevator. To steady the panel as it is built up on the elevator platform 159 and is moved vertically by the elevator 55, guides are provided for slidably engaging the opposite faces of the panel adjacent its side edges. These guides, as shown in FIG. 24, are in the form of pairs of vertically extending guide brackets 170 which are carried at different levels by crossbeams 169 which are rigidly secured to the lower posts sections 162 at desired levels. The guide brackets 170 are connected to each horizontal beam 169 by means of bolt and slot connections 171 which permit adjustment towards and from the respective faces of the panel P in accordance with the size of the blocks being laid. The beams 169 are both carried by the post sections 162 and are located at opposite sides thereof and at different levels. The inner beams is at a lower level below that of the upper run of the conveyor 53, in its lowered position, so that guides 170 will be at a sufficiently low level as not to interfere with the blocks as they are removed from the conveyor 53 and deposited on the elevator 55. The outer beam 169 is at a higher level, about the level of the upper run of conveyor 53 when it is raised. These guides will engage opposite faces of the panel and keep it plumb.

Figure 38:
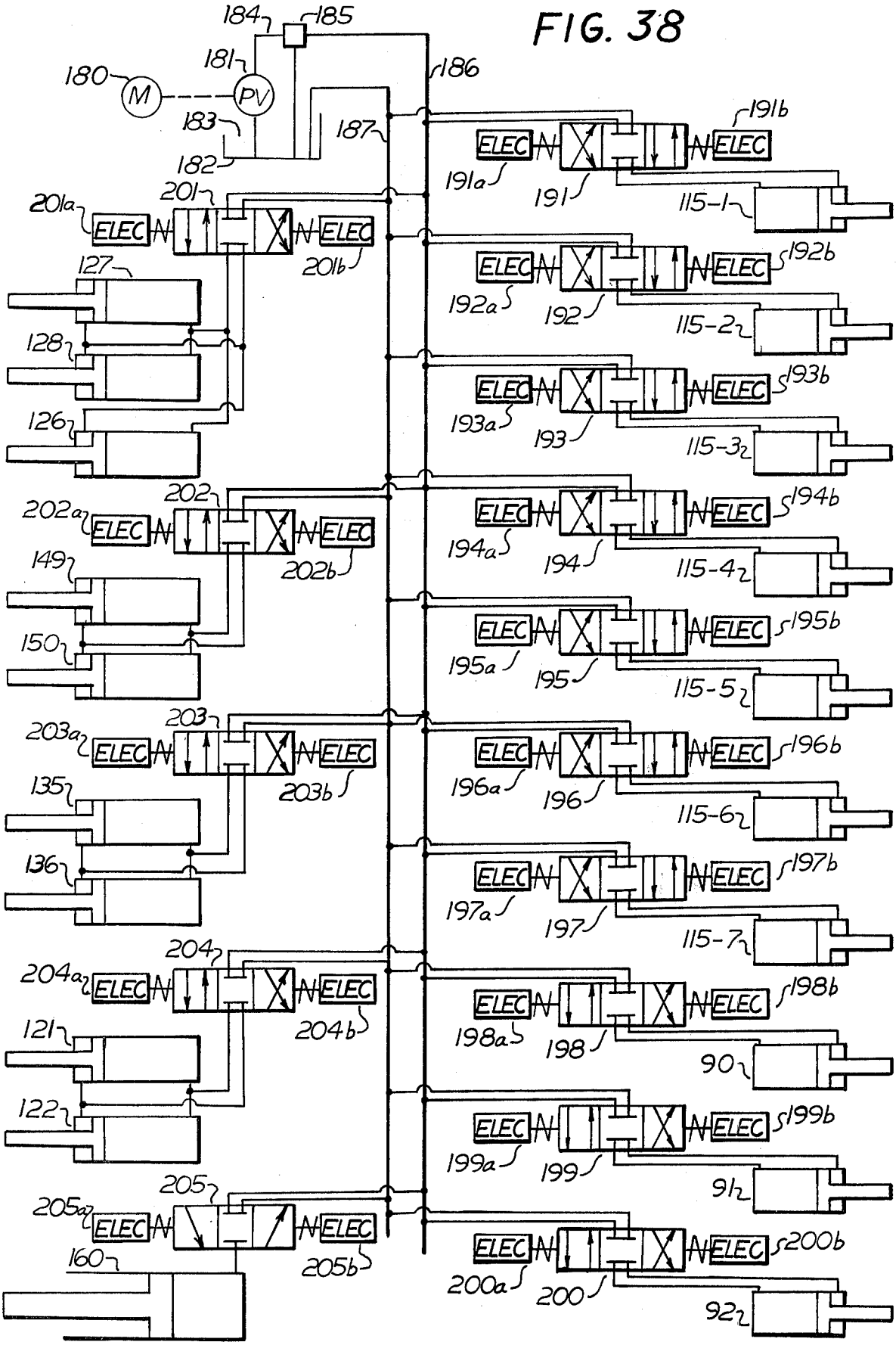
FIG. 38 is a schematic diagram of the hydraulic circuit of the machine.
Figure 39:
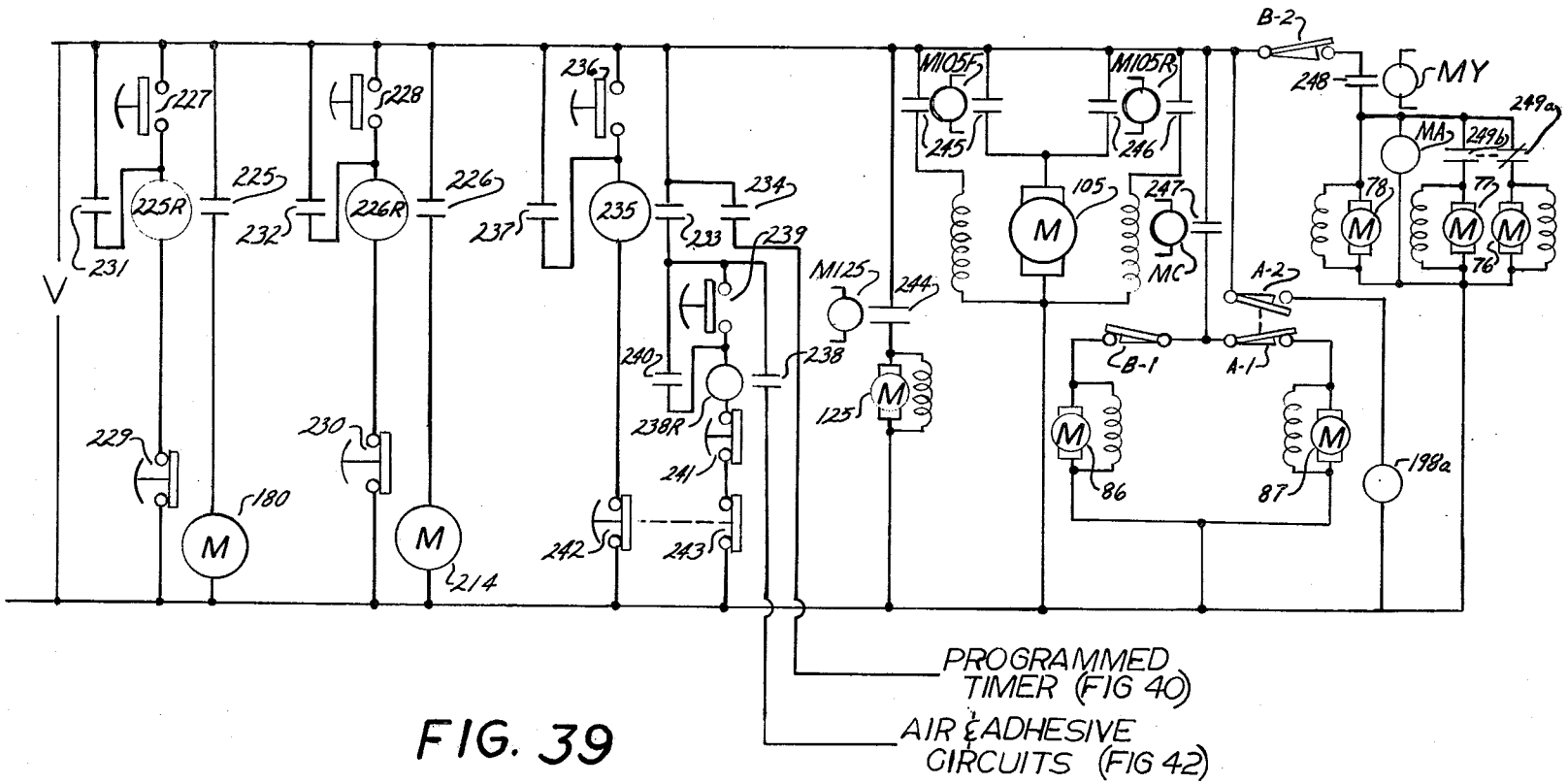
FIG. 39 is a schematic diagram of the main electrical power circuit of the machine.
Figure 40:
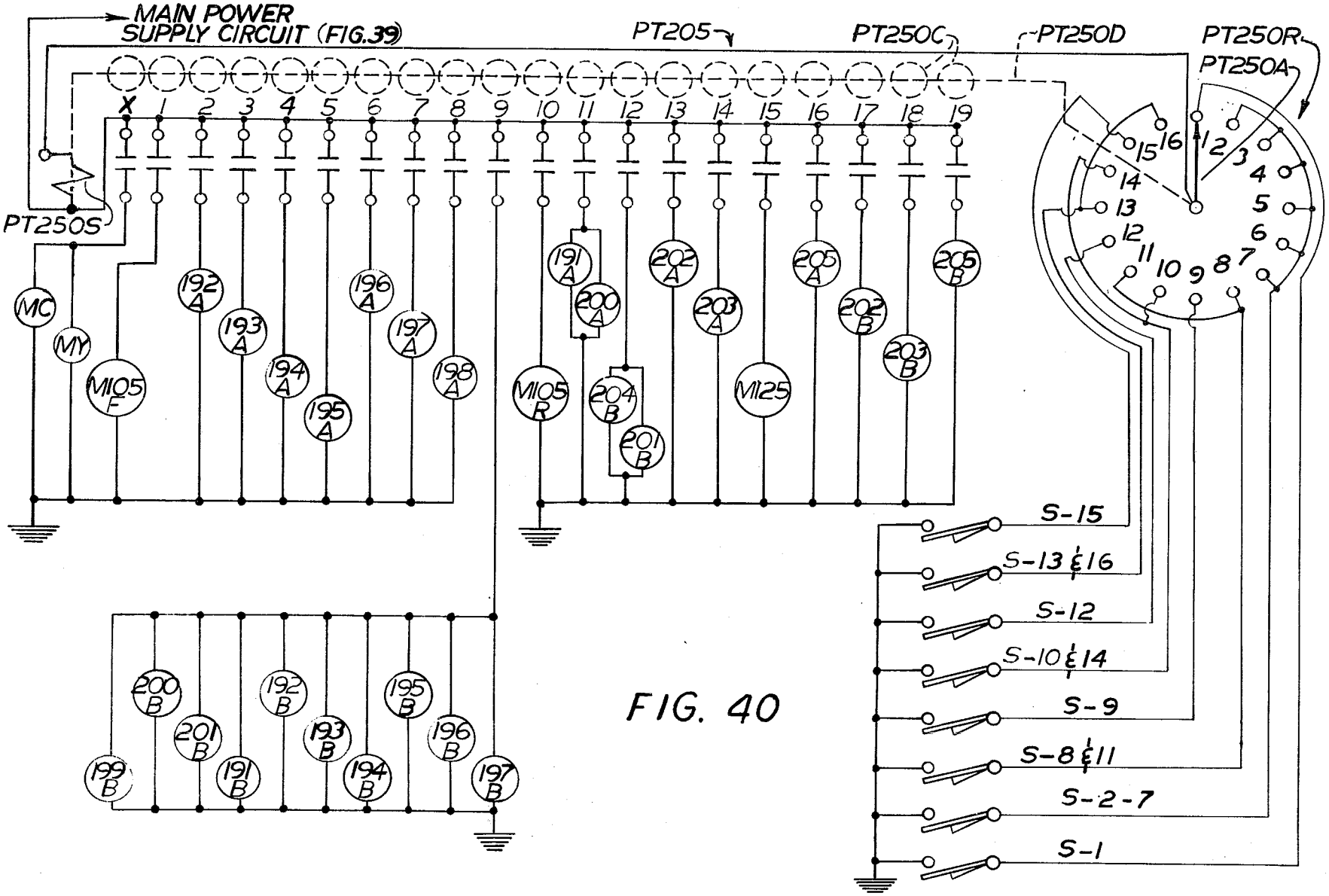
FIG. 40 is a schematic diagram of the programmed timer.
Figure 42:
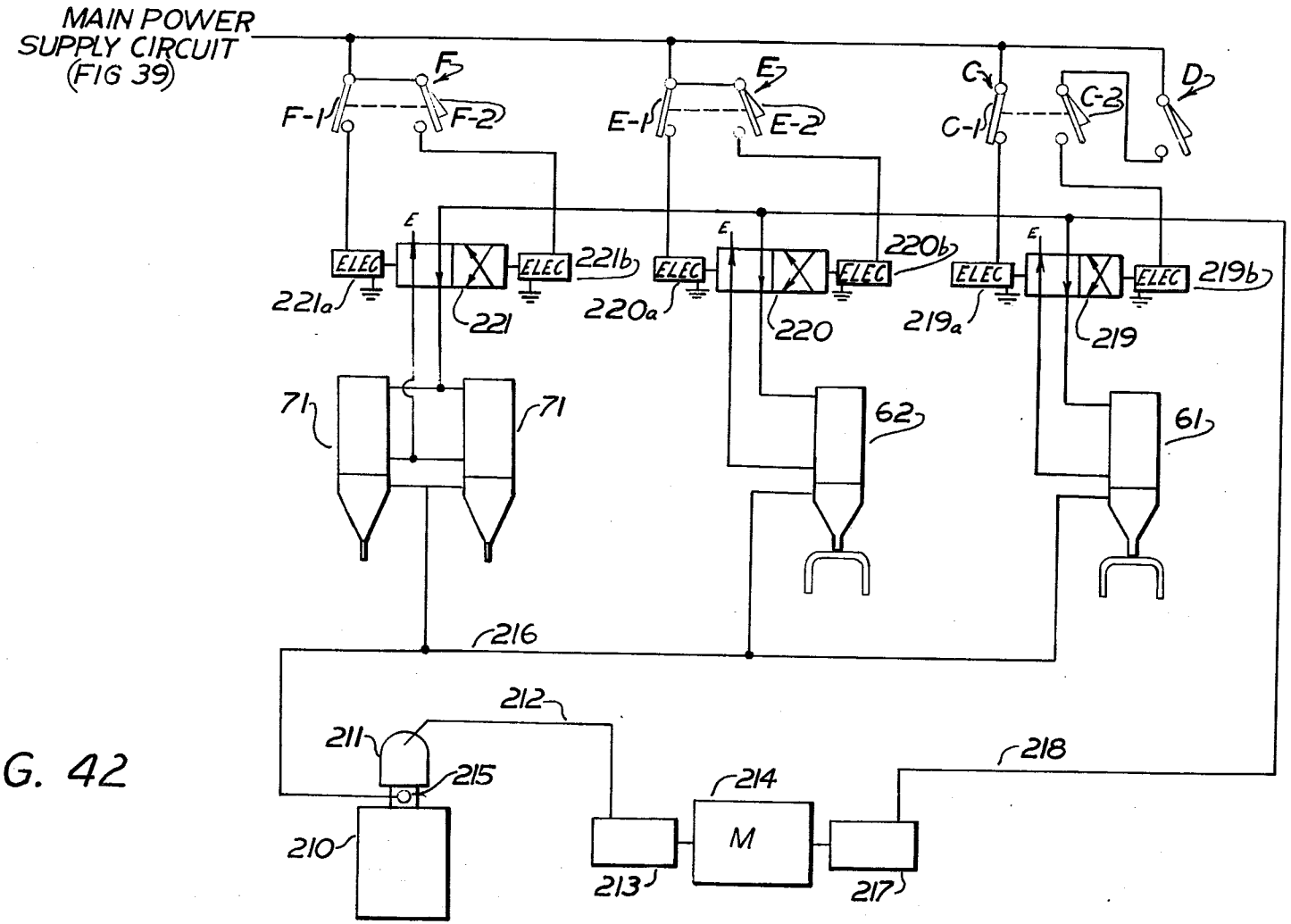
FIG. 42 is a schematic illustration of the air and electric control system for the adhesive flow guns.

The electrical, hydraulic and air control circuits and systems are diagrammatically illustrated in FIGS. 38-42. FIG. 38 includes the hydraulic circuit schematic with the electrical operating solenoids for the several valves indicated and identified for location on the electrical circuit diagrams. FIG. 39 includes the main electrical power supply controls for the apparatus and showing interconnection to the several electrical drive motors for the conveyors, carriage, hydraulic system and air system. FIG. 40 illustrates the programmed timer PT250 and associated circuitry with FIG. 41 graphically illustrating the operating times for the several contacts of the timer. FIG. 42 illustrates the air control and adhesive flow system. Interconnection of the circuits of FIGS. 40 and 42 with the main electrical power circuit of FIG. 39 is indicated in each instance. In addition to a more detailed description of the components and elements of the control circuits and systems, a sequential operation cycle will be described to better illustrate functioning of the machine.

With reference to FIG. 38, the hydraulic circuit for operating the various units of the machine includes a hydraulic pump 181 driven by an electric motor 180. A hydraulic fluid reservoir tank 182 is provided with a suction inlet conduit 183 leading from the reservoir to an inlet part of the pump 181. An outlet part of the pump connects with a conduit 184 carrying pressurized hydraulic fluid to the system and is provided with a relief valve 185 having a return drain to the reservoir to prevent buildup of an excessive pressure in the system. Distribution of pressurized hydraulic fluid to the several valves of the system and return of fluid to the several valves of the system and return of fluid is most efficiently accomplished by a manifold apparatus on which all of the valves may be conveniently mounted. This manifold is represented in FIG. 38 by the pair of conduits designated 186 and 187 with the one conduit 186 being connected to the pressure supply conduit 184 and the other conduit 187 having a return to the reservoir tank 182. The electrical control for operation of the motor 180 is shown in FIG. 39 and will be described in further detail.

All of the hydraulic control valves, excepting that for the elevator 55, are of the three-position, four way type having respective pairs of electrical actuating solenoids and are consecutively numbered 191-204 as indicated in FIG. 38. In the center position, each of these valves has all parts blocked thus locking the associated ram or cylinder and piston unit in the position to which it was last moved. These valves are also spring centered thus returning the valves to the position where all parts are blocked whenever both solenoids are denergized. All of the rams excepting that for the elevator 55 are of the double acting type with each being numerically identified; those for the clamps carrying a second number designated the associated clamp. The elevator ram 160 is single acting requiring pressurized fluid only for extension of the piston rod. Accordingly, the valve 205 controlling this ram is a three-position, two way type having spring centering and dual electric actuating solenoids. The solenoids for the valves are designated by the valve number with the subscripts *a* and *b* for the respective solenoid. It will be noted that these solenoids are incorporated in the electrical circuit diagrams and carry the same numerical identification.

The adhesive supply system is diagrammatically illustrated in FIG. 42 and shows the adhesive supply connections with the flow guns 61, 62 and 71 as well as the air and electric control circuits. A suitable bonding adhesive is supplied to the flow guns from a container 210 of the selected adhesive by means of an extrusion pump 211. This extrusion pump 211 is advantageously of the air operated type having an operating air inlet connected by a conduit 212 to an accumulator 213 which, in turn, is supplied from an electric motor driven compressor unit 214. An adhesive discharge outlet 215 on the extrusion pump 211 is connected by a conduit 216 to an inlet part of each of the flow guns 61, 62 and 71.

These flow guns are preferably of the type having an air operated valve mechanism (not shown as these guns are commercially available and well known) which require pressurized air to either open or close the discharge orifice to the respective nozzles. An air-electric control circuit is thus provided to operate the flow guns in coordination with the cyclic operation of the machine. Pressurized air for the gun control is supplied by a second compressor included in the compressor unit 214 and having an accumulator 217 to maintain isolation of the two air circuits which are also usually of different pressures. A conduit 218 leads from the second accumulator 217 to an inlet part of each of three air control valves 219, 220 and 221. These valves are of a two-position, four way type having pairs of electric actuating solenoids identified by the same number as the respective valve but with the subscripts *a* and *b*. Each of these valves 219, 220 and 221 is shown in the position where pressurized air is routed to the respective flow gun so as to maintain the gun in an off flow condition. It will be noted that the guns thus have one section of their internal control vented to atmosphere through an exhaust part of a respective valve.

An electrical control circuit is provided for these valves 219, 220 and 221 and is indicated as deriving its electrical power from the main electrical circuit shown in FIG. 39. Controlling the operation of these valves are the four limit switches C, D, E and F which have been previously located on the machine in the preceding detailed structural description thereof. Each of the three limit switches C, E and F is of the two pole type having one pole in a normally closed position and the other normally open. Actuation of the switch thus moves the one pole, designated C-1, E-1, and F-1, to an open position while the others, C-2, E-2 and F-2, is moved to a closed position. Thus, the switches C, E and F normally energize the solenoids 219 *a*, 220*a* and 221*a* to maintain the associated valve in a position where the respective flow gun is an off flow-condition. The limit switch D is a normally-open, single pole switch connected in series with the normally open pole C-2 of limit switch C. Consequently, both switches C and D must be concurrently actuated to complete an electrical circuit to solenoid 219*b* and thereby actuate valve 219 to place the flow gun 61 in an on flow condition.

As previously indicated, electrical power is obtained for all machine and auxiliary components through the main electrical power supply circuit shown in FIG. 39 and indicated to be connected to a suitable electrical power source. Both the hydraulic pump motor 180 and the motor of the air compressor unit 214 are controlled by separate and independent controller circuits. These circuits include solenoid actuated, normally open contactors 225 and 226 connected in series with the respective motor. Each solenoid 225, 226 is thus closed upon energization of its respective solenoid 225 R, 226 R. Energization is initially affected by manual closing of the respective normally-open, push-button contacts 227, 228 that are series connected with the respective solenoid and respective normally-closed, push-button contacts 229, 230. A holding circuit is provided for each circuit in the form of respective, auxiliary normally-open contacts 231, 232 which are connected in series with the solenoids and are closed upon energization of the solenoid at the time that the respective contact 227 or 228 is momentarily closed. Opening of the normally closed contacts 229, 230 will result in opening of holding circuit for stopping of the respective motors 180 and 214.

Electrical power to the programmed timer circuit and the air and adhesive control circuit is provided through a controller also having holding circuits. This controller includes the primary, normally open contactors 233, 234 which provide electrical power independently to each circuit although electrical power will only be provided to the air and adhesive circuit if the programmed timer circuit is energized. A solenoid 235, when energized, closes both contactors 233, 234 in response to momentary manual closing of a normally-open push-button contact 236 connected in series with the solenoid. An auxiliary, normally open contact 237 connected in series with the solenoid 235 forms a holding circuit.

A secondary controller is provided for the air and adhesive circuit and includes a normally open contactor 238 which is closed by the solenoid 238 R which is energized upon momentary closing of a normally-open, push-button contact 239 connected in series therewith. An auxiliary, normally open contact 240 connected in series with the solenoid 238 R is closed upon energization of the solenoid and thus forms a holding circuit. A normally closed, push-button contact 241 connected in circuit with the solenoid 238 R permits the air and adhesive circuit to be selectively and independently deenergized from the programmed timer circuit. A manual switch having mechanically interconnected, normally closed contacts 242 and 243 connected in series with solenoids 235 and 238 R, respectively, enables simultaneous deenergization of the programmed timer circuit and the air and adhesive circuit. This will prevent inadvertant discharge of adhesive in the event that it is desired to stop operation of the machine.

Also interconnected in the main electrical power circuit are the power and control circuits for the motors which drive the conveyors 50*a*, 50*b*, 50*c*, 51*a*, 51*b* and 53 and the drive motor for the feeder carriage 52. The motor 125 for revolving the conveyor 53 is connected to the electrical power source through a contactor 244. Contactor 244 which is normally open is closed upon energization of its associated solenoid M125 which is connected into the programmed timer circuit. The motor 105 which drives the feeder carriage 52 in forward and reverse directions includes forward and reverse windings which are selectively interconnected with the electrical power supply by respective sets of contactors 245 and 246. The solenoids M105 F and M105 R are interconnected in the programmed timer circuit for selective energization and closing of the respective sets of contactors 245, 246.

A primary contactor 247 which is normally open controls the energization of the two motors 86 and 87 that drive the respective conveyor sections 51*a* and 51*b*. The motors 86 and 87 are connected in parallel to the contactor 247 for simultaneous starting when the contactor operating solenoid MC connected in the programmed timer is energized. Normally closed contacts A-1 and B-1 of the limit switches A and B are connected in the circuits of the respective motors 87 and 86. These switches are actuated when the leading block on the respective conveyor, 51*a* and 51*b*, reaches the location of the switch and thus engages and actuates the switch thereby stopping that conveyor. The limit switch A includes a second contact A-2 that is normally open and connected in series with the valve solenoid 198*a*. Contact A-2 is closed when the leading block on conveyor 51*b* reaches switch A and energizes solenoid 198*a* to actuate valve 198 and extend the piston rod of cylinder 90 to project the stop pin of block locator 51*c* across conveyor 51*a*.

The three Y-conveyor motors 78, 76 and 77 are primarily controlled by a normally open contactor 248 which is closed upon energization of its solenoid MY. Solenoid MY is connected into the programmed timer circuit. Secondary control of the two motors 76 and 77 driving the respective branch conveyor sections 50*a* and 50*b* is attained by a controller having an actuating solenoid MA and two contactors 249*a* and 249*b*. These contactors 249*a* and 249*b* are mechanically interconnected so that when one contactor is closed the other will be open and each will be maintained in the position in which it is last placed. Successive energization of solenoid MA will thus alternatingly energize motors 76 and 77 as the contactors 249*a* and 249*b* will be alternatingly opened and closed. This operation of the controller enables the blocks on conveyors 50*a* and 50*b* to be alternatingly fed onto conveyor section 50*c* and subsequently onto conveyor 51.

Limit switch B includes another normally closed contact B-2 which is series connected with the contactor 248. It is the function of this contact to deenergize the Y conveyor motors 78, 76 and 77 for stopping of the conveyors 50*a*, 50*b* and 50*c* simultaneously with stopping of conveyor section 51*a*.

With reference to FIG. 40, the programmed timer circuit is schematically shown with the programmed timer PT250 only diagrammatically illustrated. This circuit receives electrical power from the main electrical power supply circuit of FIG. 39 as indicated. The programmed timer PT250 is a commercially available device which comprises a number of cam operated contacts with the cams PT250C for all contacts mounted on a common drum PT250D that can be revolved. An actuating or stepping solenoid PT250S is provided and operates on the drum to revolve the drum in a series of sequential steps, 16 in this device, during each revolution. Energization of the stepping solenoid is controlled by a rotary selector switch PT250R having a movable arm contact PT250A carried by the drum and is thus also revolved in sequential steps. As the drum PT250D revolves, the arm contact PT250A will sequentially engage each one of a series of the 16 sequentially numbered contacts. A circuit is completed for energization of the stepping solenoid PT250S whenever the normally open switch contact (one of the group designated as S-1, -2-7, 8 and 11, -9, -10 and 14, -12, -13 and 16 and -15) connected to the rotary switch contact then engaged by the rotary arm contact is closed. Energization of the stepping solenoid indexes the drum to the next position and concurrently advances the rotary arm contact to the next position. It will be noted that the group of switches S-1, etc., are the switches previously located on the machine on the preceding portion of the description.

The cam operated contacts are numbered 1-19 with another contact designated X. Each contact is actuated by its own cam PT250C providing independent operation with the open and closed times for each of the 16 index positions during a complete revolution being graphically indicated in FIG. 41. These contacts are connected to the several motor controller and hydraulic valve solenoids as indicated and thus energize these solenoids in accordance with the program determined by this timer.

For better understanding operation of the machine a cyclic sequence is described with initial assumption that the programming timer PT250 is in position 1. In this position, the conveyor 53 will be revolving as the solenoid M125 of the controller for the conveyor will be energized. When PT250 indexed to position 1, switch contacts 18 closed resulting in energization of valve solenoid 203*b* causing retraction of the piston rods in cylinders 135, 136 for moving the transfer unit 54 to the pickup position. Concurrently, switch contacts 11 of PT250 also closed thereby energizing valve solenoid 191*a* and actuating valve 191 to cause retraction of the piston rod of the cylinder 115-1 for the first clamp 1*a*. Clamp 1*a* thus grips the first block on conveyor 51*b*. Concurrently with energization of valve solenoid 191*a*, valve solenoids 200*a* and 199*b* are energized to actuate their respective valves 200 and 199. Valve 199 will then retract the stop pin 51d from over conveyor 51*b* and valve 200 will then cause piston of cylinder 92 to extend and lift a half block, if a half block is present, at the trailing end of the course of blocks on conveyor 51*a*. Switch contact 17 will remain closed at this time keeping valve solenoid 202*b* energized to continue opening of the clamps of the transfer unit 54 through retraction of the piston rods of cylinders 149, 150.

When the conveyor 53 has revolved to index the pairs of guides 70 to the next position, that is, with the next succeeding pair of guides 70 aligned with the conveyor 51 to receive the next course of blocks, one of the guide rails 70 on the lower run of conveyor 53 will engage switch S-1 and close its normally open contacts. Closing of the S-1 contacts completes a circuit through the stepping solenoid PT250S to index the drum to position 2. Conveyor 53 now stops as contact 15 opens thus deenergizing the controller solenoid M 125 for the drive motor 125 of this conveyor. Contact 1 of PT250 is now closed and energizes the forward solenoid M105F of the controller for the drive motor 105 of the feeder carriage 52 which moves in a direction to move the course of blocks from conveyor 51*b* to the guides 70.

As the carriage 52 moves in a forward direction, switch S2-7 successively engages the clips 2*b*-7*b* mounted in spaced relationship on the frame element 60 and is actuated six times to close its normally open contacts and sequentially energize the stepping solenoid PT205S at each closing of the switch contacts. This sequentially closes the contacts 2-7 of PT250 and energizes the solenoids 192*a*, 193*a*, 194*a*, 195*a*, 196*a* and 197*a* of the respective valves 192, 193, 194, 195, 196 and 197 thereby causing retraction of the piston rods for the actuating cylinders 115 of the clamps 2*a*-7*a*. Each of the blocks in a course are thus successively clamped as the carriage 52 moves forwardly. Appropriate location of the switch actuating clips 2*b*-7*b* produces proper timing in actuation of the switch S2-7 to successively clamp the blocks while the carriage is moving. When the last clamp 7*a* closes, the drum of PT250 will have been indexed to position 8.

Upon completion of forward travel of the feeder carriage 52, with the course of blocks now tipped over and located on the guides 70, the lug 65 on the arm of clamp 6*b* engages and actuates switch 8 and 11 to close its normally open contacts. This energizes the stepping solenoid PT205S to index the drum to position 9 thereby opening contacts 1-7 and 11 which deenergizes the carriage drive motor solenoid M105F and the clamp valve solenoids 191*a*, 192*a*, 193*a*, 194*a*, 195*a* 196*a* and 197*a*. Consequently, the carriage drive motor 105 stops but the clamps 1a-7a continue to grip the respective blocks.

Indexing of the timer PT250 to position 9 closes contact 8 which energizes valve solenoid 204a causing the piston rods of the elevating cylinders 121, 122 to extend. This causes the conveyor 53 to swing upwardly with the conveyor actuating switch S-9 at the upward extent of its travel. Actuation of switch S-9 closes its contacts thereby energizing the stepping solenoid PT250S to index the drum to position 10. In position 10, contact 8 remains closed and contacts 9 and 13 are closed. Closing of contact 9 simultaneously energizes all of the clamp valve solenoids 191b, 192b, 193b, 194b, 195b, 196b and 197b causing extension of the piston rods in each of the respective cylinders 115 (1-7) and release of the blocks which will then be fully supported on the guide 70. Simultaneously with release of the blocks, valve solenoid 201a is energized along with energization of solenoid 191b, etc., and actuates valve 201 to extend the pistons of the cylinders 126, 127 and 128 of the pushers 53a and 53b. As previously stated, the pushers force a course of blocks into end contacting relationship and center the course on the guides 70 of the conveyor 53. Solenoid 199a is also energized to actuate valve 199 to extend the stop 51d over conveyor 51b. Also, at this time, valve solenoid 200b is energized actuating valve 200 to retract the piston of cylinder 92 and lower the half-block lift. Closing of contact 13 energizes valve solenoid 202a which results in extension of the piston rods of the clamping cylinders 149, 150 and clamping of a course of blocks by the transfer unit 54. Simultaneously, contact 17 opens thereby deenergizing valve solenoid 202b to permit operation of valve 202 in clamping the blocks.

As the clamp of transfer unit 54 closes, a structural member of the movable clamp arm engages and actuates switch S10 and 14 closing its normally open contacts and energizing the stepping solenoid PT250S. This indexes the drum to position 11 and closes contacts 10 and 12 while maintaining contact 13 closed. Closing of contact 10 energizes the reverse solenoid M105R of the contactor for the drive motor 105 of the feeder carriage 52 which is now driven in a reverse direction. Closing of contact 12 energizes valve solenoid 204b thereby actuating that valve 204 to retract the piston rods of cylinder 121 and 122 to lower the conveyor 53. Closing of contact 12 also energizes valve solenoid 201b to actuate valve 201 in retracting the piston rods of cylinders 126, 127 and 128 of the pushers 53a and 53b.

With the drun in position 11, contact 11 is also closed and energizes the motor control solenoids MC and MY. These solenoids thus close their respective contactors 247 and 248 to start the conveyor motor 87 and permit motors 86, 78, 76 and 77 to start when the blocks on conveyor 51a have been transferred to conveyor 51b. Switch B remains actuated by the blocks and its contacts B-1 and B-2 are held open until the last block leaves conveyor 51a and then conveyors 51a, 50c and either 50a or 50b will be started. Upon initial movement of the feeder carriage 52 in a reverse direction, lug 65 on an arm of block clamp 6b again engages switch S8 and 11 to close its normally open contacts thereby energizing stepping solenoids PT250S and indexing the drum to position 12. In position 12, contacts 14 close to energize valve solenoid 203a which actuates valve 203 to extend the piston rods of cylinders 135, 136 and move the transfer unit 54 forward to position the course of blocks clamped in the unit over the elevator 55. At this time the conveyor 53 will have been lowered and not interfere with this transfer of a course of blocks to a position over the elevator. Upon completion of the forward movement of the transfer unit 54, a member of that unit engages and actuates switch S12 to close its normally open contacts to energize stepping solenoid PT250S and index the drum to position 13 thereby closing contact 16. Closing of contact 16 energizes valve solenoid 205a to actuate valve 205 and cause the elevator piston rod to extend in raising the elevator toward the course of blocks carried by the transfer unit 54.

Upward movement of the elevator 55 brings the actuating arm of switch S 13 and 16 mounted on the elevator into engagement with the next above one of the clips 1c-18c attached to the elevator frame. Actuation on switch S13 and 16 on upward movement of the elevator closes its normally open contacts and energizes the stepping solenoid PT250S to index the drum to position 14 which closes contact 17. Valve solenoid 202b is thereby energized and actuates valve 202 to retract the piston rods of cylinders 149, 150 in opening of the transfer unit clamp. This releases the course of blocks which are now supported on the elevator.

In opening of the transfer unit clamp, a structural member thereof again engages and actuates switchs S10 and 14 to close its contacts thereby energizing the stepping solenoid PT250S and indexing the drum to position 15. Contact 19 then closes energizing valve solenoid 205b and actuation of valve 205 to permit lowering of the elevator 55. During the time that the drum has been indexing from position 11 to position 15, contact X has remained closed and is still closed thus maintaining the conveyor motor solenoids MC and MY energized. Accordingly, the conveyors 51a, 51b, 50c, 50a and 50b are enabled to operate as determined by the switches A and B. The course of blocks are first transferred from conveyor 51a to 51b as previously indicated. After the blocks of this course have left conveyor 51a, switch B is then configured to close its contacts B-1 and B-2 and thus enable conveyors 51b and 50 to operate. The blocks transferred onto conveyors 51b continue to move until the leading block engages the top pin 51d and, at that time, also engages switch A which is actuated. Actuation of switch A opens contact A-1 thereby disconnecting motor 87 and stopping conveyor 51b. Concurrently, contact A-2 is closed and energizes valve solenoid 198a to actuate valve 198 to extend the piston rod of cylinder 90 to project stop pin 51c over conveyor 51a. Conveyors 51a and 50 continue to run until such time as a succeeding course of blocks has moved onto conveyor 51a and the leading block engages the extended stop pin 51c. At this point, switch B is also engaged and actuated to open its contacts B-1 and B-2 thereby deenergizing the conveyor motors 86, 78 and whichever motor 76 or 77 may have been operating. Conveyors 51a and 50 are also now stopped and this block transfer will have been completed prior to the time that the drum is indexed to position 16 and open contact X to assure deenergization of the motor control solenoids MY and MC.

During the time that the conveyor 53 was lowered, the transfer unit 54 moved forward and the elevator 55 moved upward, the feeder carriage 52 will have returned to its initial starting position and have engaged switch S 15. Its normally open contacts are then closed thereby energizing stepping solenoid PT250S and indexing the drum to position 16. This indexing of the drum also opens contacts 10 which deenergizes the carriage reverse solenoid M105R and stops motor 105. Contact 15 is concurrently closed when the drum reaches position 16 and energizes the contactor solenoid M125 and starts the drive motor 125 for the conveyor 53.

Downward movement of the elevator 55 continues until the switch S13 and 16 engages and is actuated by the next lower one of the clips 2c-19c. Actuation closes its normally open contacts which energizes the stepping solenoid PT250S and indexes the drum to position 1. This indexing movement opens contact 19 to deenergize valve solenoid 205b thus permitting valve 205 to return to center and stop further downward movement of the elevator. The machine is now returned to the original starting configuration and another cycle may be initiated.

During the time that the feeder carriage 52 moves between its two positions over either conveyor 51 or conveyor 53, the adhesive flow guns are operated to discharge beads of adhesive onto the upper surfaces of the blocks. As the carriage 52 moves off from 51, switch C engages the stationary member or rail 60a and is actuated to close contact C-2 while opening contact C-1. As the carriage 52 moves toward conveyor 53, the trigger 63 will engage the first block, either a full block or a half block supported on the lift 51e, and will close switch D. Closing of switch D then completes an electrical circuit through switch contact C-2 to energize solenoid 219b of the air valve 219 and results in operation of the flow gun 61 to discharge adhesive. When the actuating arm of switch C drops off of rail 60a at a point which coincides with the juncture of the first and second blocks on conveyor 51a, adhesive flow will be stopped to prevent coating of the end of the endmost block at the stop pin 51c. Switch C returns to the illustrated normal position and the air valve 219 will be actuated to assure closing of a discharge valve in the flow gun 61 through energization of solenoid 219a.

When the feeder carriage 52 begins its return movement after positioning a course of blocks on the conveyor 53, switch E engages member 60c and is actuated to close contact E-2 thereby energizing solenoid 220b and operating valve 220 to open flow gun 62 and permit discharge of adhesive onto the blocks which are now supported on a pair of guides of conveyor 53. Switch E returns to a normal position when its actuating arm disengages from the member 60c and valve 220 is operated to stop adhesive flow from gun 62 through energization of solenoid 220a.

Application of adhesive to the ends of a course of blocks carried on a pair of guides 70 of the conveyor 53 is controlled by switch F. Switch F detects the block and is actuated thereby to close contact F-2 thereof and energize solenoid 221b thereby actuating the valve 221 to open the flow guns and permit discharge of adhesive. After the block passes switch F during movement of conveyor 53, switch F returns to its normal position to energize solenoid 221a and stop the flow guns 71.

The action of the machine when courses of blocks are passed therethrough has been described. However, in some instances it may be desirable to incorporate one or more lintels in the panel. If so, the elongated lintel can be passed through the machine by placing it flat on the conveyor 51. It will then be moved through the machine substantially like the course of blocks. Since the tilting roller 66 is only slightly higher then the roller 80b it will pass thereover but this roller can be removable or virtually adjustable so it can be lowered if necessary. The lintel will be conveyed by the conveyor, similar to a course of blocks, but the pusher 126 and 127-128 will merely center it. The transfer unit 54 will act on it substantially like it acts on a course of blocks.

As indicated, the panel shown is only an example of various types of panels which can be made according to this invention.

It will be apparent from the preceding description that the present invention provides for completely automatically laying building blocks of various standard sizes, although, it is not limited thereto, into panels of selected widths and lengths. The machine in which this invention is embodied will advance the blocks, arrange them in courses and lay the courses into a panel, all automatically. The courses will be arranged in the panel as desired. Also, the machine can be adjusted readily to handle blocks of various sizes.

Having thus described the invention, what is claimed is:

1. The method of automatically laying building blocks into a panel of superimposed courses which comprises positioning on a feeder conveyor successive rows of blocks with each block resting on end on the conveyor and with the successive rows consisting of a predetermined number and type of blocks to form a desired course, advancing the feeder conveyor towards a course-forming conveyor which moves at a right-angle thereto and which is provided with course-forming guides for receiving the advanced blocks, clamping the blocks of each row supported on the feeder conveyor while upright to suspend them for turning about a transverse axis and turning them 90° about said axis while they are advanced toward and into the guides and arranging them in end-to-end spaced relationship in the guides, pushing the blocks of the row in the guides together in end-to-end contact to form a course, and clamping the formed course and moving it over an elevator onto which the formed course is released and positioned for support by the elevator.

2. The method of automatically laying building blocks into a panel as claimed in claim 1 in which the blocks are supplied on the feed conveyor and are moved together to form successive rows and adhesive is applied to the upper ends of the blocks of each row successively as they are clamped and fed towards the course-forming conveyor so that when the blocks are pushed together in the guides the adjacent ends will adhere together to form a course.

3. The method of claim 2 including applying adhesive to the top edges of the course of blocks formed in the guides before the formed course is clamped for movement over the elevator.

4. The method of claim 3 including applying adhesive to the top edges of the end blocks of the course of adhered blocks in the guides before it is clamped for movement over the elevator.

5. The method of claim 4 including lowering the elevator in steps to receive the successive formed courses of blocks which are laid thereon and which will adhere together.

6. The method of claim 1 including lowering the elevator in steps to receive the successive formed courses which are laid thereon.

7. The method of claim 5 including supplying the feeder conveyor with blocks as successive rows of full-length blocks with half-blocks at the opposite ends of the row, and raising the trailing half-block of each row to the level of the adjacent full block so that its upper edge will be coated with adhesive and then lowering it before it is clamped and fed into the course-forming guides.

8. The method of claim 7 including supplying the feeder conveyor with rows of blocks from an automatic supply conveyor which has different sections that alternately feed rows of different types of blocks onto the feeder conveyor.

9. A machine for automatically laying building blocks into a panel of superimposed courses comprising an in-feed conveyor upon which successive rows of blocks are positioned with each block resting on end on the conveyor and with the successive rows consisting of a predetermined number and type of blocks to form a desired course, means for advancing the in-feed conveyor, a course-forming conveyor which is provided with successive guide channels to align with the in-feed conveyor to receive from the in-feed conveyor blocks of a row, fed thereby, means for successively clamping the blocks of each row supported by the in-feed conveyor and advancing them towards and into the aligned guide channel of the course-forming conveyor where they will be arranged into end-to-end relationship to form a course, and transfer means for gripping the formed course and depositing it on a suitable support, said course-forming conveyor being provided with successive guides which form said successive guide channels movable by the conveyor to successively align with the course, said means for clamping the successive blocks of each row supported by the in-feed conveyor and advancing them towards the guides of the course-forming conveyor having means cooperating therewith to turn the successively-clamped blocks 90° so that they will be arranged on the guides in end-to-end relationship, means for moving the blocks of each row on the guides together in end-to-end contact to form a course, said transfer means comprising a transfer unit for clamping the formed course in the guides, and said suitable support comprising an elevator over which the transfer unit moves to release and position the formed course thereon and which can be lowered to receive successive formed courses of blocks transferred thereto.

10. A machine according to claim 9 in which the in-feed conveyor is a straight-line conveyor for moving the blocks toward the course-forming conveyor and the course-forming conveyor is movable at a right-angle thereto, said elevator being located at one-end of the course-forming conveyor, and means for advancing the course-forming conveyor toward the elevator.

11. A machine according to claim 10 in which the in-feed conveyor is of the roller type with sets of rollers disposed therealong consisting of rollers free at all times and other rollers driven at selected times so that the driven rollers can advance the blocks therealong or the said clamping means can advance the blocks therealong.

12. A machine according to claim 11 in which the block-turning means includes a tilting roller between the in-feed and course-forming conveyors for successively engaging the clamped blocks.

13. A machine according to claim 9 in which the in-feed conveyor consists of successive leading and following sections with means for independently driving the sections, each of said sections having a block-stopping unit operating therewith to stop successive rows of blocks at a predetermined location on each of the sections.

14. A machine according to claim 13 in which each of said block-stopping units includes a ram.

15. A machine according to claim 13 in which a block-lift is provided in cooperation with the following section of the in-feed conveyor behind the block-stopping unit provided in cooperation therewith.

16. A machine according to claim 15 including a ram for operating the block-lift.

17. A machine according to claim 15 in which a supply-conveyor is provided for supplying successive rows of blocks automatically onto the in-feed conveyor, said supply conveyor including two-separate sections which converge into the in-feed conveyor, and means for alternately operating each of said sections.

18. A machine according to claim 17 in which the supply conveyor is of Y-form with the two sections converging on a common third section which connects with the in-feed conveyor, and means for independently driving each of the three sections.

19. A machine according to claim 17 in which the supply and in-feed conveyors are provided with laterally-spaced longitudinal guide rails extending over the conveyors and forming block guide-channels, and means for mounting said rails for adjustment towards and from each other to receive different size blocks.

20. A machine according to claim 9 in which said means for clamping and advancing the successive blocks of a row supported on the in-feed conveyor comprises a carriage mounted for reciprocating movement over the in-feed conveyor and the aligned guides of the course-forming conveyor, and a series of clamps depending from the carriage for stradling and clamping successive blocks of the row.

21. A machine according to claim 20 including means for actuating each of said clamps independently.

22. A machine according to claim 21 in which each clamp-actuating means comprises a ram.

23. A machine according to claim 21 in which each clamp comprises a pair of depending arms having clamp members carried thereon for rotation about a transverse axis to permit turning of the blocks.

24. A machine according to claim 23 in which each of said rotatable clamp members has yieldable means for movably holding and returning it to its original position.

25. A machine according to claim 24 in which said yieldable means comprises a torsion spring at the axis of the rotatable member, and stop means for stopping the rotatable member at a selected position to which it is returned under the influence of said spring.

26. A machine according to claim 25 in which means is provided between the depending clamp arms for varying the spacing therebetween to receive blocks of different sizes.

27. A machine according to claim 23 including a pair of spaced support rails extending above the in-feed conveyor and the course-forming conveyor, rollers on said carriage which rest on said rails so that the carriage can be reciprocated thereon, and a reversible motor on the carriage for driving at least some of said rollers to propel it along said rails.

28. A machine according to claim 21 in which an adhesive-supplying flow gun is carried at each end of the carriage for applying adhesive to the upper edges of rows of blocks supported respectively on said in-feed conveyor and said course-forming conveyor.

29. A machine according to claim 9 in which the course-forming conveyor is of the endless type that carries successive pairs of guides in the form of members spaced apart in parallel relationship and extending transversely of the path of movement of the conveyor, said elevator being disposed at the discharge end of the conveyor, and means for advancing the conveyor toward the elevator.

30. A machine according to claim 29 in which the guide members of each pair are mounted on the conveyor for adjustment toward and from each other to receive blocks of different sizes therebetween.

31. A machine according to claim 30 in which the conveyor advancing means includes a drive motor.

32. A machine according to claim 31 in which said means for moving the blocks on the guides together comprises a pusher member which is reciprocated over the guides into and out of engagement with the blocks slidably supported thereon.

33. A machine according to claim 32 including a ram for actuating the pusher member.

34. A machine according to claim 33 including a pair of centering pushers beyond the first pusher in the direction of movement of the conveyor and reciprocable towards and from each other over the conveyor to engage the course of blocks in the respective pair of guide members to center it thereon.

35. A machine according to claim 34 including simultaneously-actuated rams for actuating the pair of pushers.

36. A machine according to claim 35 including a pair of adhesive flow guns disposed in cooperation with the course-forming conveyor for applying adhesive to the top edges of the respective ends of the formed and centered course.

37. A machine according to claim 34 in which the transfer unit is mounted over the course-forming conveyor adjacent its discharge end for reciprocating movement above the conveyor toward and from the elevator, and means for reciprocating the transfer unit.

38. A machine according to claim 37 in which said transfer unit carries supporting rollers, supporting rails for receiving the rollers and extending in parallel relationship in the direction of movement of the conveyor at a suitable level above the conveyor, and said reciprocating means comprises a pair of simultaneously actuated rams.

39. A machine according to claim 38 in which said transfer unit comprises clamping means for engaging the formed course in the guides on the conveyor, and means for actuating said clamping means.

40. A machine according to claim 39 in which said clamping means comprises a fixed clamp member for engaging one side of the formed course and a movable clamp member for engaging the other side of the course, said actuating means comprising a pair of simultaneously actuated rams connected to the movable member.

41. A machine according to claim 40 in which the movable member has an extensible and retractable edge for adjustment to different size blocks clamped by the transfer unit.

42. A machine according to claim 40 in which said course-forming conveyor is mounted for vertical swinging movement at its discharge end about a transverse axis at its inlet end, and means for vertically moving the conveyor.

43. A machine according to claim 42 in which said moving means comprises a pair of simultaneously-actuated rams.

44. A machine according to claim 29 in which said elevator comprises a platform which is disposed transversely at the discharge end of the course-forming conveyor for vertical movement relative thereto, and means for actuating said elevator for vertical movement.

45. A machine according to claim 44 in which said actuating means comprises a vertically disposed ram connected to said platform.

46. A machine according to claim 44 including vertical posts for guiding the vertical movement of the elevator, said posts including main lower support sections and upper guide sections which telescope and reciprocate therein, and guide brackets connected to said guide sections and extending through vertical guide slots in said lower sections, said guide brackets being connected to opposite ends of said elevator platform.

47. A machine according to claim 46 including means cooperating with the elevator to steady the panel and hold it plumb as it is built up on the platform, said means comprising guide means supported at opposite sides of the path of movement of the platform for engaging the opposed faces of the panel, said guide means being mounted on support beams carried by said lower post sections.

48. A machine according to claim 47 including means for mounting the guide members on said beams for adjustment towards and from the face of the panel in accordance with the size of the blocks being laid.

49. A machine according to claim 9 in which the in-feed conveyor comprises a plurality of sections independently driven by electrically-actuated motors, means for driving the course-forming conveyor including an electrically actuated motor, said means for clamping the successive blocks and advancing them comprising a series of successive clamps depending from a carriage mounted for reciprocating movement over the in-feed conveyor and the course-forming conveyor guides, means for driving the carriage along the guides comprising a reversible electrically-actuated motor, means for actuating the successive clamps on the carriage comprising an electrically-actuated ram for each clamp, means for actuating the block-moving means comprising an electrically-actuated ram, said transfer unit being mounted for reciprocating movement above the course-forming conveyor toward and from said elevator which is located at the discharge end of the conveyor, electrically-actuated rams connected to said transfer unit for reciprocating it, said transfer unit including relatively movable clamping members, electrically-actuated rams for moving said clamping members between clamping and non-clamping positions, said elevator including a platform, an electrically-actuated ram connected to said platform for vertically moving it, and a control circuit for actuating all of said electrically-actuated motors and rams in proper sequence.

50. A machine according to claim 49 including means for centering the blocks on the guides before they reach the transfer unit, said means comprising opposed electrically-actuated ram units at the sides of the conveyor for engaging the respective ends of the formed course in the cooperating guides, which are connected in said electric circuit.

51. A machine according to claim 50 in which the in-feed conveyor is a straight-line conveyor for moving the blocks toward the course-forming conveyor and the course-forming conveyor is movable at a right-angle thereto with a discharge end adjacent the elevator, said in-feed conveyor including a leading and following section, and an electrically-actuated drive motor for each section, the drive motors being connected in said electric circuit, each of said sections having an electrically-actuated block-stopping ram unit cooperating therewith to stop successive rows of blocks at a predetermined location on each of the sections which is also connected in said circuit.

52. A machine according to claim 51 in which the course-forming conveyor is mounted for vertical movement at its discharge end, and electrically-actuated rams for producing said vertical movement which are connected in said electric-circuit.

53. A machine according to claim 52 in which a block-lift is provided in cooperation with the following section of the in-feed conveyor behind the block-stopping unit, and an electrically-actuated ram for said lift connected in said electric circuit.

54. A machine according to claim 53 in which a supply conveyor of Y-form is provided for supplying blocks to the in-feed conveyor, said supply conveyor having two converging sections and a common receiving section, and electrically-actuated motors for independently controlling the respective three sections, all of said motors being connected in said electric circuit.

55. A machine according to claim 54 in which an air-actuated electrically-controlled adhesive flow gun is carried at each end of the carriage for applying adhesive to the upper edges of rows of blocks supported respectively on said in-feed conveyor and said course-forming conveyor, and a pair of air-actuated electrically-controlled adhesive supply guns are provided over the course-forming conveyor beyond the pusher for applying adhesive to the top edges of the formed block course in said guides at the ends of the course, all of said guns being connected in said electric circuit.

56. A machine according to claim 55 including an air-actuated electrically-controlled pump connected to all of said flow guns for supplying adhesive thereto.

57. A machine according to claim 56 in which all of said rams are incorporated in a hydraulic circuit which includes hydraulic valves for controlling the respective rams, said valves being solenoid-operated, said flow guns being incorporated in an air circuit which includes air valves for controlling the respective guns, said valves being solenoid operated.

58. A machine according to claim 57 in which said circuit includes limit switches mounted on various units of the machine and a programmed timer connected in the circuit for controlling the solenoids of the various valves and the various drive motors.

59. A machine for automatically laying building blocks into a panel of superimposed courses comprising an in-feed conveyor upon which successive rows of blocks are positioned with the successive rows consisting of a predetermined number and type of blocks to form a desired course, means for advancing the in-feed conveyor, a course-forming conveyor which is provided with successive guide channels to successively align with the in-feed conveyor to receive from the in-feed conveyor blocks of a row, fed thereby, means for successively clamping the blocks of each row supported by the in-feed conveyor and advancing them towards and into the aligned guide channel of the course-forming conveyor where they will be arranged into end-to-end relationship to form a course, and transfer means for gripping the formed course and depositing it on a suitable support, said course-forming conveyor being provided with successive guides which form said successive guide channels movable by the conveyor to successively align with the course, means for advancing said course-forming conveyor step-by-step in timed relationship to the advance of said clamping means, means for moving the blocks of each row on the guides together in end-to-end contact to form the course, said transfer means comprising a transfer unit for clamping the formed course in the guides, means for operating the transfer means in timed relationship to said course-forming conveyor course, said suitable support comprising an elevator over which the transfer unit moves to release and position the formed course thereon and which can be lowered to receive successive formed courses of blocks transferred thereto, and means for operating said elevator in timed relationship to said transfer means.

60. A machine according to claim 59 in which the in-feed conveyor is a straight-line conveyor for moving the blocks toward the course-forming conveyor and the course-forming conveyor is movable at a right-angle thereto, said elevator being located at one-end of the course-forming conveyor, and means for advancing the course-forming conveyor toward the elevator.

61. A machine according to claim 60 in which the in-feed conveyor is of the roller type with sets of rollers disposed therealong consisting of rollers free at all times and other rollers driven at selected times so that the driven rollers can advance the blocks therealong or the said clamping means can advance the blocks therealong.

62. A machine according to claim 60 in which the in-feed conveyor consists of successive leading and following sections with means for independently driving the sections, each of said sections having a block-stopping unit cooperating therewith to stop successive rows of blocks at a predetermined location on each of the sections.

63. A machine according to claim 62 in which each of said block-stopping units includes a ram.

64. A machine according to claim 62 in which a block-lift is provided in cooperation with the following section of the in-feed conveyor behind the block-stopping unit provided in cooperation therewith.

65. A machine according to claim 64 including a ram for operating the block-lift.

66. A machine according to claim 64 in which a supply-conveyor is provided for supplying successive rows of blocks automatically onto the in-feed conveyor, said supply conveyor including two-separate sections which converge into the in-feed conveyor, and means for alternately operating each of said sections.

67. A machine according to claim 66 in which the supply conveyor is of Y-form with the two sections converging on a common third section which connects with the in-feed conveyor, and means for independently driving each of the three sections.

68. A machine according to claim 59 in which said means for clamping and advancing the successive blocks of a row supported on the in-feed conveyor comprises a carriage mounted for reciprocating movement over the in-feed conveyor and the aligned guides of the course-forming conveyor, and a series of clamps depending from the carriage for stradling and clamping successive blocks of the row.

69. A machine according to claim 68 including means for actuating each of said clamps.

70. A machine according to claim 69 in which each clamp-actuating means comprises a ram.

71. A machine according to claim 69 including a pair of spaced support rails extending above the in-feed conveyor and the course-forming conveyor, rollers on said carriage which rest on said rolls so that the carriage can be reciprocated thereon, and a reversible motor on the carriage for driving at least some of said rollers to propel it along said rails.

72. A machine according to claim 59 in which the course-forming conveyor is of the endless type that carries successive pairs of guides in the form of members spaced apart in parallel relationship and extending transversely of the path of movement of the conveyor, said elevator being disposed at the discharge end of the conveyor, said operating means for advancing the conveyor moving it toward the elevator.

73. A machine according to claim 72 in which the conveyor advancing means includes a drive motor.

74. A machine according to claim 72 in which said means for moving the blocks on the guides together comprises a pusher member which is reciprocated over the guides into and out of engagement with the blocks slidably supported thereon.

75. A machine according to claim 74 including a ram for actuating the pusher member.

76. A machine according to claim 75 including a pair of centering pushers beyond the first pusher in the direction of movement of the conveyor and reciprocable towards and from each other over the conveyor to engage the course of blocks in the respective pair of guide members to center it thereon.

77. A machine according to claim 76 including simultaneously-actuated rams for actuating the pair of pushers.

78. A machine according to claim 76 in which the transfer unit is mounted over the course-forming conveyor adjacent its discharge end for reciprocating movement above the conveyor toward and from the elevator, said transfer operating means including means for reciprocating it.

79. A machine according to claim 78 in which said transfer unit carries supporting rollers, supporting rails for receiving the rollers and extending in parallel relationship in the direction of movement of the conveyor at a suitable level above the conveyor, and said reciprocating means comprises a pair of simultaneously actuated rams.

80. A machine according to claim 79 in which said transfer unit comprises clamping means for engaging the formed course in the guides on the conveyor, and means for actuating said clamping means.

81. A machine according to claim 80 in which said clamping means comprises a fixed clamp member for engaging one side of the formed course and a movable clamp member for engaging the other side of the course, said actuating means comprising a pair of simultaneously actuated rams connected to the movable member.

82. A machine according to claim 81 in which said course-forming conveyor is mounted for vertical swinging movement at its discharge end about a transverse axis at its inlet end, and means for vertically moving the conveyor.

83. A machine according to claim 82 in which said moving means comprises a pair of simultaneously-actuated rams.

84. A machine according to claim 72 in which said elevator comprises a platform which is disposed transversely at the discharge end of the course-forming conveyor for vertical movement relative thereto, said means for actuating said elevator causing vertical movement thereof.

85. A machine according to claim 84 in which said actuating means comprises a vertically disposed ram connected to said platform.

86. A machine according to claim 84 including vertical posts for guiding the vertical movement of the elevator, said posts including main lower support sections and upper guide sections which telescope and reciprocate therein, and guide brackets connected to said guide sections and extending through vertical guide slots in said lower sections, said guide brackets being connected to opposite ends of said elevator platform.

87. A machine according to claim 86 including means cooperating with the elevator to steady the panel and hold it plumb as it is built up on the platform, said means comprising guide means supported at opposite sides of the path of movement of the platform for engaging the opposed faces of the panel, said guide means being mounted on support beams carried by said lower post sections.

88. A machine according to claim 87 including means for mounting the guide members on said beams for adjustment towards and from the face of the panel in accordance with the size of the blocks being laid.

89. A machine according to claim 59 in which the in-feed conveyor comprises a plurality of sections independently driven by electrically-actuated motors, said means for advancing the course-forming conveyor including an electrically actuated motor, said means for clamping the successive blocks and advancing them comprising a series of successive clamps depending from a carriage mounted for reciprocating movement over the in-feed conveyor and the course-forming conveyor guides, said in-feed conveyor advancing means driving the carriage along the guides and including a reversible electrically-actuated motor, means for actuating the successive clamps on the carriage comprising an electrically-actuated ram for each clamp, means for actuating the block-moving means comprising an electrically-actuated ram, said transfer unit being mounted for reciprocating movement above the course-forming conveyor toward and from said elevator which is located at the discharge end of the conveyor, electrically-actuated rams connected to said transfer unit for reciprocating it, said transfer unit including relatively movable clamping members, electrically-actuated rams for moving said clamping members between clamping and non-clamping positions, said elevator including a platform, said means for operating the elevator including an electrically-actuated ram connected to said platform for vertically moving it, and a control circuit for actuating all of said electrically-actuated motors and rams in proper sequence.

90. A machine according to claim 89 including means for centering the blocks on the guides before they reach the transfer unit, said means comprising opposed electrically-actuated ram units at the sides of the conveyor for engaging the respective ends of the formed course in the cooperating guides, which are connected in said electric circuit.

91. A machine according to claim 90 in which the in-feed conveyor is a straight-line conveyor for moving the blocks toward the course-forming conveyor and the course-forming conveyor is movable at a right-angle thereto with a discharge end adjacent the elevator, said in-feed conveyor including a leading and following section, and an electrically-actuated drive motor for each section, the drive motors being connected in said electric circuit, each of said sections having an electrically-actuated block-stopping ram unit cooperating therewith to stop successive rows of blocks at a predetermined location on each of the sections which is also connected in said circuit.

92. A machine according to claim 91 in which the course-forming conveyor is mounted for vertical movement at its discharge end, and electrically-actuated rams for producing said vertical movement which are connected in said electric-circuit.

93. A machine according to claim 92 in which a block-lift is provided in cooperation with the following section of the in-feed conveyor behind the block-stopping unit, and an electrically-actuated ram for said lift connected in said electric circuit.

94. A machine according to claim 93 in which a supply conveyor of Y-form is provided for supplying blocks to the in-feed conveyor, said supply conveyor having two converging sections and a common receiving section, and electrically-actuated motors for independently controlling the respective three sections, all of said motors being connected in said electric circuit.

95. A machine according to claim 94 in which all of said rams are incorporated in a hydraulic circuit which includes hydraulic valves for controlling the respective rams, said valves being solenoid-operated.

96. A machine according to claim 96 in which said circuit includes limit switches mounted on various units of the machine and a programmed timer connected in the circuit for controlling the solenoids of the various valves and the various drive motors.

* * * * *

UNITED STATES PATENT OFFICE

CERTIFICATE OF CORRECTION

Patent No. 4,067,766 Dated January 10, 1978

Inventor(s) George K. Larger

It is certified that error appears in the above-identified patent and that said Letters Patent are hereby corrected as shown below:

Column 23: lines 28 and 29, cancel "to successively align with the course".

Column 28: lines 3 and 4, cancel "to successively align with the course"

line 12, cancel "course".

Signed and Sealed this

Sixteenth Day of May 1978

[SEAL]

Attest:

RUTH C. MASON
Attesting Officer

LUTRELLE F. PARKER
Acting Commissioner of Patents and Trademarks